US007169525B2

(12) United States Patent
Sugiura et al.

(10) Patent No.: US 7,169,525 B2
(45) Date of Patent: Jan. 30, 2007

(54) TONER, DEVELOPER, IMAGE FORMING APPARATUS, PROCESS CARTRIDGE AND IMAGE FORMING PROCESS

(75) Inventors: Hideki Sugiura, Fuji (JP); Satoshi Mochizuki, Numazu (JP); Yasuaki Iwamoto, Numazu (JP); Yasuo Asahina, Numazu (JP); Kazuhiko Umemura, Sunto-gun (JP); Tomoyuki Ichikawa, Numazu (JP); Shinya Nakayama, Numazu (JP); Tomoko Utsumi, Numazu (JP); Koichi Sakata, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/184,976

(22) Filed: Jul. 20, 2005

(65) Prior Publication Data

US 2006/0040194 A1 Feb. 23, 2006

Related U.S. Application Data

(63) Continuation of application No. PCT/JP04/00379, filed on Jan. 19, 2004.

(30) Foreign Application Priority Data

Jan. 20, 2003 (JP) ..... 2003-010901

(51) Int. Cl.
*G03G 9/08* (2006.01)

(52) U.S. Cl. ..... 430/108.4; 430/108.6; 430/109.4; 430/110.1

(58) Field of Classification Search ..... 430/108.4, 430/108.1, 109.4, 110.1, 108.6
See application file for complete search history.

(56) References Cited

U.S. PATENT DOCUMENTS

| | | | | |
|---|---|---|---|---|
| 6,308,027 | B1 | 10/2001 | Obu et al. | |
| 6,436,599 | B1 * | 8/2002 | Matsuoka et al. | 430/137.19 |
| 6,542,707 | B2 | 4/2003 | Muramatsu et al. | |
| 6,597,883 | B2 | 7/2003 | Muramatsu et al. | |
| 6,628,908 | B2 | 9/2003 | Matsumoto et al. | |
| 6,628,913 | B2 | 9/2003 | Matsumoto et al. | |
| 6,630,276 | B2 | 10/2003 | Sugiura et al. | |
| 6,667,141 | B2 | 12/2003 | Iwamoto et al. | |
| 6,674,982 | B2 | 1/2004 | Saitoh et al. | |
| 6,697,584 | B2 | 2/2004 | Tsunoda et al. | |
| 6,725,003 | B2 | 4/2004 | Shinkai et al. | |
| 6,757,507 | B2 | 6/2004 | Mochizuki et al. | |
| 6,757,515 | B2 | 6/2004 | Ueda | |
| 6,770,411 | B2 | 8/2004 | Masuda et al. | |
| 6,775,511 | B2 | 8/2004 | Kosuge | |
| 6,780,556 | B2 | 8/2004 | Sugiura et al. | |
| 6,790,575 | B2 | 9/2004 | Sasaki et al. | |
| 6,816,695 | B2 | 11/2004 | Nakai et al. | |
| 6,818,369 | B2 | 11/2004 | Sugiura et al. | |
| 6,828,075 | B2 | 12/2004 | Suzuki et al. | |
| 6,832,061 | B2 | 12/2004 | Saito et al. | |
| 6,835,517 | B2 | 12/2004 | Kondo et al. | |
| 6,838,220 | B2 * | 1/2005 | Matsumura et al. | 430/110.3 |
| 6,856,781 | B2 | 2/2005 | Matsuda et al. | |
| 6,861,191 | B2 | 3/2005 | Mochizuki et al. | |
| 6,898,405 | B2 | 5/2005 | Matsumoto et al. | |
| 6,902,857 | B2 | 6/2005 | Yagi et al. | |
| 2003/0027074 | A1 * | 2/2003 | Emoto et al. | 430/124 |
| 2003/0152857 | A1 | 8/2003 | Sugiura et al. | |
| 2003/0165760 | A1 * | 9/2003 | Higuchi et al. | 430/108.4 |
| 2003/0180643 | A1 | 9/2003 | Suzuki et al. | |
| 2003/0190543 | A1 | 10/2003 | Sugiura et al. | |
| 2003/0232266 | A1 | 12/2003 | Sugiura et al. | |
| 2003/0235436 | A1 | 12/2003 | Kasahara et al. | |
| 2004/0000753 | A1 | 1/2004 | Fukuchi | |
| 2004/0053154 | A1 | 3/2004 | Tomita et al. | |
| 2004/0058260 | A1 | 3/2004 | Kotoh et al. | |

FOREIGN PATENT DOCUMENTS

| | | |
|---|---|---|
| JP | 06-348055 | 12/1994 |
| JP | 2663016 | 6/1997 |
| JP | 09-319143 | 12/1997 |
| JP | 10-20549 | 1/1998 |
| JP | 2001-134011 | 5/2001 |
| JP | 3225889 | 8/2001 |
| JP | 2002-6541 | 1/2002 |
| JP | 2002-287400 | 10/2002 |
| JP | 2002-351143 | 12/2002 |
| JP | 2002-357929 | 12/2002 |
| JP | 2002-372806 | 12/2002 |
| JP | 2003-29594 | 10/2003 |

* cited by examiner

*Primary Examiner*—John L Goodrow
(74) *Attorney, Agent, or Firm*—Oblon, Spivak, McClelland, Maier & Neustadt, P.C.

(57) ABSTRACT

The object of the present invention is to provide a toner which is excellent in shelf stability for a long term by producing the toner through controlling the dispersion condition of the wax around the toner surface and through improving, not only the off-set resistance of the toner for rendering the fixing properties of the toner advantageous, but also the blocking resistance of the toner, wherein the toner contains a binder resin, a colorant, and a wax, wherein the amount of the wax is 3% by mass to 21% by mass, and the amount of the wax which is present in the portion of the toner particle which is in the range of from the outermost surface to the depth of 0.3 μm in the toner particle is in a specified range, and at least a part of the wax is present as plural individual wax dispersion particles involved in the toner particles.

26 Claims, 7 Drawing Sheets

TONER, DEVELOPER, IMAGE FORMING APPARATUS, PROCESS CARTRIDGE AND IMAGE FORMING PROCESS

CROSS-REFERENCE TO RELATED APPLICATIONS

This is a continuation of Application No. PCT/JP2004/000379, filed on Jan. 19, 2004.

BACKGROUND OF THE INVENTION

1. Field of the Invention

The present invention relates to a toner used for an image forming in an electrostatic copying process of a copying machine, facsimile or printer.

2. Description of the Related Art

In the image forming apparatus for the electrophotography, a toner image is formed on the photoconductor through the steps comprising charging the surface of the photoconductor which is a carrier of the image by the discharge, exposing the surface of the charged photoconductor for forming a latent electrostatic image on the surface of the photoconductor and developing the latent electrostatic image formed on the surface of the photoconductor by supplying a toner having a polarity which is reverse to the polarity of the latent static image formed on the surface of the photoconductor to the latent static image. The toner image formed on the photoconductor is, thereafter, transferred to an intermediate transferring medium temporary and is either transferred to a recording member, such as a paper from the intermediate transferring medium, or through transferring the toner image from the photoconductor directly to the recording medium, fixed on the recording medium by applying heat and pressure to the transferred toner image on the recording medium.

In the above-noted fixing step, the recording member is put between a pair of fixing members in the form of a roller or a belt which are equipped with a heater in the inside thereof and the toner is molten by the heating and pressed, so that the toner image is fixed on the recording member. At this time, when the heating temperature of the toner is too high, the toner is fused excessively and a disadvantage is caused that the toner is fused to the fixing member (hot offset). On the other hand, when the heating temperature is too low, the toner is not satisfactorily fused and a disadvantage is caused that the fixing itself becomes unsatisfactory. From the viewpoint of saving the energy and the downsize of the image forming apparatus, a toner having high resistance to the hot offset (i.e., the hot offset of a toner is caused at a high temperature) and the low temperature image fixing properties (i.e., a toner can be fixed at a low temperature) is required. It is also necessary that the toner is not blocked either during the storage of the toner or at the temperature of the atmosphere in the image forming apparatus (i.e., the toner has high resistance to the blocking).

Particularly, in the full-color copying machine and the full-color printer, it is necessary that the image has high glossiness and high mixed-color properties and the toner has accordingly a low molten viscosity, so that as a component of the toner, a toner binder of a polyester resin having sharp melt properties. Since in using such a toner, the hot off-set is easily caused, conventionally in the apparatus for the full-color, the fixing member is coated with a silicone oil. However, for coating the fixing member with the silicone oil, an oil tank and an oil coating unit are necessary, so that the image forming apparatus becomes complicated and large. Also, the deterioration of the fixing member is caused, so that a maintenance of every fixed period becomes necessary. Further, the silicone oil is inevitably attached to a paper for the copying or a film for OHP (over head projector) and particularly with respect to OHP, the tone of the image is impaired due to the attached silicone oil.

Thus, for preventing the fusion of the toner without coating the fixing member with the silicone oil, generally a method of mixing the toner with a wax is used. However, the releasing effect of the wax varies largely depending on the dispersion condition of the wax in the binder resin of the toner.

In Japanese Patent (JP-B) No. 2663016, it is described that by producing the toner through a suspension polymerization of a substance having a polar group with a polymerizable monomer composition comprising a releasing agent in water, a wax having a low melting point which cannot be used in the toner produced by a grinding manufacturing method, can be incorporated in the composition of. It is considered that a non-polar component, such as a wax is not present in the surface of the toner particles, on the contrary to a polar component, but present in such a pseudo-capsule structure that the non-polar component is covered by a polar component which is present in the surface of the toner particles. However, the distribution of the wax in the inside of the toner particle is not yet analyzed and is unclear.

In JP-B No. 3225889, described is a toner in which the amount of the wax is 0.1% by mass to 40% by mass, based on the mass of the toner composition and the ratio of the mass of the wax which is present in the surface of the toner particles to the mass of all components of the toner composition which are present in the surface of the toner particles is 1% by mass to 10% by mass. In this patent document, the ratio of the wax which is present in the surface of the toner particles is defined by measuring the above-noted ratio of the wax using ESCA. However, the range of the ESCA analysis is restricted to a range of from the outermost surface of the toner particle to the depth of around 0.1 μm in the toner particle, so that by the ESCA analysis, the dispersion condition of the wax which is present in a deeper portion of the toner particle than the depth of around 0.1 μm and which exhibits releasing properties during fixing an image, cannot be clarified.

In Japanese Patent Application Laid-Open (JP-A) No. 2002-6541, described is a toner in which the wax is involved in the toner particle and is localized in the surface of the toner particle. However, in this patent document, the detailed dispersion condition of the wax around the surface of the toner particle is unclear.

SUMMARY OF THE INVENTION

The task of the present invention is to solve the above-noted problems accompanying the background art and to attain the following object.

The object of the present invention is to provide a toner in which by controlling the dispersion condition of the wax around the surface of the toner, not only fixing properties of the toner is advantageous through improving the hot-offset resistance of the toner, but also the long-term shelf stability of the toner is rendered excellent through improving the blocking resistance of the toner.

The method by which the above-noted task can be solved is as follows.

<1> A toner comprising:

a binder resin, a colorant, and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

<2> The toner according to item <1> above, wherein the amount of the wax is 3% by mass to 20% by mass, based on the total mass of the toner.

<3> The toner according to any one of items <1> to <2> above, wherein the wax dispersion particles are uniformly dispersed in the toner particle.

<4> The toner according to any one of items <1> to <3> above, wherein a surface area of the wax which is present in the outermost surface of the toner particle is 5% or less, based on the area of the outermost surface of the toner particle.

<5> The toner according to any one of items <1> to <4> above, wherein the toner has a path through which the wax is oozed out to the surface of the toner particle by heating and pressing the toner.

<6> The toner according to any one of items <1> to <5> above, wherein the wax is any one of a carnauba wax from which a free fatty acid is eliminated, a rice wax, a montan wax, an ester wax and a combination thereof.

<7> The toner according to any one of items <1> to <6> above, wherein the binder resin comprises a modified polyester resin.

<8> The toner according to item <7> above, wherein the binder resin comprises an unmodified polyester resin together with the modified polyester resin and the amount ratio of the modified polyester resin to the unmodified polyester resin in terms of the mass ratio is 5/95 to 80/20.

<9> The toner according to any one of items <7> to <8> above, wherein the binder resin has a peak molecular mass of 1,000 to 10,000.

<10> The toner according to any one of items <7> to <9> above, wherein the binder resin has a glass transition point (Tg) of 35° C. to 70° C.

<11> The toner according to any one of items <7> to <10> above, wherein the toner is produced by subjecting a toner material-contained solution for producing the toner which is a dispersion in which at least a polyester prepolymer having a functional group containing a nitrogen atom, a polyester resin, a colorant and a releasing agent are dispersed in an organic solvent, to at least one of a crosslinking reaction and an elongation reaction in an aqueous medium.

<12> The toner according to item <11> above, wherein the toner is produced by dispersing the toner material-contained solution in an aqueous medium under the presence of resin fine particles.

<13> The toner according to any one of items <1> to <12> above, wherein the toner has a volume average particle diameter (Dv) of 3.0 μm to 8.0 μm and a ratio (Dv/Dn) of the volume average particle diameter (Dv) to the number average particle diameter (Dn) of 1.00 to 1.40.

<14> The toner according to any one of items <1> to <13> above, wherein the toner has an average circularity of 0.93 to 1.00.

<15> The toner according to any one of items <1> to <14> above, wherein the toner has a substantially spherical shape.

<16> The toner according to claim <1> to <15>, wherein the shape of the toner is defined by a maximum length r1, a minimum length r2, and a thickness r3, wherein r1≧r2≧r3; and r2/r1 is 0.5 to 1.0, and r3/r2 is 0.7 to 1.0.

<17> The toner according to any one of items <1> to <16> above, wherein at least one of a hydrophobic silica and hydrophobic titanium oxide is added in the toner as an outer additive.

<18> The toner according to any one of items <1> to <17> above, wherein the toner has a glass transition point (Tg) of 35° C. to 60° C.

<19> A two-component developer for developing a latent electrostatic image comprising:

a toner, and a carrier, wherein the toner is comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

<20> An image forming apparatus comprising:

a photoconductor, a charging unit configured to charge the photoconductor, an exposing unit configured to expose the photoconductor for forming a latent electrostatic image a developing unit configured to develop the latent electrostatic image using a toner for forming a toner image, which is supplied with the toner, a transferring unit configured to transfer the toner image carried on the photoconductor to a recording medium, and a fixing unit configured to fix the toner image carried on the recording medium, wherein the toner is a toner comprising a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

<21> The image forming apparatus according to item <20> above, wherein the fixing unit comprises a heater equipped with a heating element, a film contacted with the heater and a pressing member contacted with the heater through the film; and a recording medium carrying an unfixed image is inserted between the film and the pressing member so as to heat and fix the toner image.

<22> The image forming apparatus according to item <20> above, wherein the photoconductor is an amorphous silicone photoconductor.

<23> The image forming apparatus according to item <20> above, wherein the developing unit is equipped with an electric-field applying unit configured to apply an alternating electric field to the photoconductor for developing the latent image on the photoconductor.

<24> The image forming apparatus according to any one of items <20> to <23> above, wherein the charging unit charges the photoconductor by contacting the photoconductor with a charging member of the charging unit and by applying a voltage to the charging member.

<25> A process cartridge comprising:

a photoconductor; and at least one unit selected from the group consisting of:

a charging unit configured to charge the photoconductor, a developing unit configured to develop a latent electrostatic image using a toner for forming a toner image, which is supplied with the toner, and a cleaning unit configured to clean the toner remained on the photoconductor by using a blade after transferring the toner image, wherein the process cartridge is an integrated unit of the photoconductor and at least one unit selected from the group consisting of the charging unit, the developing unit and the cleaning unit and is attached to the main body of the image forming apparatus in an attachable and detachable manner; and the toner comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

<26> An image forming process comprising:

charging a photoconductor, exposing the photoconductor for forming a latent electrostatic image, developing the latent electrostatic image using a toner for forming a toner image, transferring the toner image carried on the photoconductor to a recording medium, and fixing the toner image carried on the recording medium, wherein the toner comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

According to the present invention, the problems accompanying the background art can be solved and a toner in which by controlling the dispersion condition of the wax around the surface of the toner, not only the fixing properties of the toner is rendered advantageous through improving the hot-offset resistance of the toner, but also the shelf-stability for a long term of the toner is rendered excellent through improving the blocking resistance of the toner.

BRIEF DESCRIPTION OF THE DRAWINGS

In FIG. 9, 25 represents a relationship between the applied voltage and the charged potential in the case where the charging is performed according to the injection-charging and 26 represents a relationship between the applied voltage and the charged potential in the case where the charging is performed according to the discharge-charging.

DESCRIPTION OF THE PREFERRED EMBODIMENTS

Figure 1:
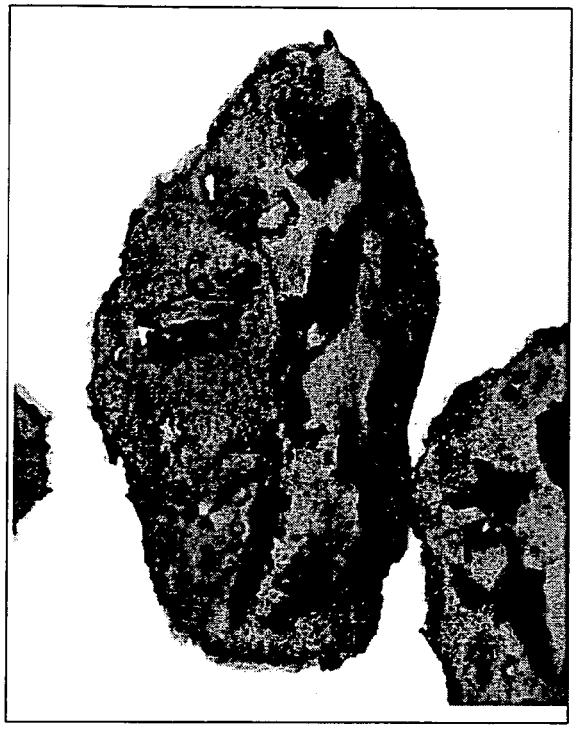
FIG. 1 is an example of the sectional TEM photograph of the toner according to the present invention.

Hereinbelow, with respect to the embodiment for carrying out the present invention, explanations are given.

The toner according to the present invention comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured by the FTIR-ATR is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

For improving the hot-offset resistance of the toner during fixing an image, the wax is present preferably in the near of the surface of the toner particle. However, when the wax is present in the outermost surface of the toner particle, the wax hinders a uniform charging of the toner and the wax exhibits the cohesiveness, thus the fluidity of the toner particle is hindered. Even when an external additive, such as inorganic fine particles is added in the toner for improving the charging properties and fluidity of the toner, the external additive is embedded by the wax which is present in the surface of the toner particle, so that the charging properties and fluidity of the toner cannot be improved. Further, during a long-termed use of the toner, the wax is transferred either to the surface of the magnetic carrier, so that the charging properties of the toner is lowered or the life of the developer is lowered, or to the surface of the photoconductor, so that the filming of the toner is caused. Moreover, when the wax which is present in the surface of the toner particle is fused at an atmospheric temperature during the storage of the toner, the toner blocking is caused, so that the shelf stability of the toner is lowered. On the other hand, when the toner is present in the inside of the toner particle as agglomerated particles, satisfactory releasing properties of the toner cannot be obtained, so that the hot-offset resistance of the toner is lowered. Thus, with respect to the toner according to the present invention, by dispersing at least a part of the wax in the toner as plural independent wax dispersion particles which are involved in the toner and by specifying both the total amount of the wax which is present in the whole toner particle and the amount of the wax which is present in a portion of the toner particle which is in the range of from the outermost surface of the toner particle to the depth of 0.3 μm in the toner particle, not only the charging properties and fluidity of the toner, but also the releasing properties of the toner could be satisfied.

In the toner according to the present invention, the dispersion condition of the wax in the toner can be specified by using the total amount of the wax which is present in the whole toner particle and the relative amount of the wax which is present in the near of the surface of the toner particle which can be measured according to the following methods. The total amount of the wax which is present in the whole toner particle can be measured according to the DSC (differential scanning calorimeter) method. More specifically, the total amount of the wax which is present in the whole toner particle is obtained by measuring the ratio of the endotherm of the wax in a sample of the toner particle to the endotherm of the wax as a simple substance using the following measuring apparatus and measuring conditions:

Measuring apparatus: Differential Scanning Calorimeter (manufactured by Shimadzu Corporation; trade name: DSC 60). Amount of sample for measuring: about 5 mg (for both the sample of the toner particle and the sample of the wax as a simple substance)

Rate of temperature elevation: 10° C./min

Temperature range for measuring: from room temperature to 150° C.

Atmosphere for measuring: atmosphere of nitrogen gas.

The total amount of the wax in the whole toner particle is calculated according to the following equation:

$$\text{Amount of wax(\% by mass)} = (\text{Endotherm of wax in toner particle (J/g)}) \times 100 / (\text{Endotherm of wax as single substance(J/g)}) \quad \text{Equation 1.}$$

Thus, by the above-noted analysis, even when the wax escapes from the toner particle during the manufacturing of the toner particle and the entire amount of the wax which is incorporated in the composition of the toner particle is not present in the manufactured toner particle, the total amount of the wax in the whole toner particle can be effectively defined.

The amount of the wax which is present in the near of the surface of the toner particle can be measured according to the FTIR-ATR method. From the principle of the measuring method, the measuring range is the range of from the outermost surface of the toner particle to the depth of around 0.3 μm in the toner particle and according to this measuring method, the amount of the wax which is present in a portion of the toner particle which is in a range of from the outermost surface of the toner particle to the depth of around 0.3 μm in the toner particle can be measured. More specifically, the measuring is performed as follows.

First, 3 g of the sample of the toner particle is shaped to pellets by pressing the sample with a load of 6 t for one minute using an automatic pelleter (trade name: Type M No. 50 BRP-E, manufactured by Maekawa Testing Machine MFG. Co., Ltd.), thereby yielded pellets of the toner particle having a diameter of 40 mm and a thickness of about 2 mm. The surface of the yielded toner pellet was analyzed according to the FTIR-ATR method using a microscope FTIR apparatus in which Spectrum One (manufactured by Perkin Elmer Corporation) is equipped with Multi scope FTIR unit (manufactured by Perkin Elmer Corporation) under the following conditions: a micro ATR of germanium (Ge) crystal having a diameter of 100 μm is used; the irradiating angle and resolving power of the infra red beam are respectively 41.5° and 4 $cm^{-1}$; the integrating times of the measurement is 20 times.

The ratio ($P_{2850}/P_{828}$) of the strength of the peak (at 2850 $cm^{-1}$) ascribed to the wax to the strength of the peak (at 828 $cm^{-1}$) ascribed to the binder resin which is measured as the result of the above-noted analysis, is registered as the relative amount of the wax which is present in the near of the surface of the toner particle. As the measured value, the average value of the values measured four times by changing the measuring point in the toner particle is used.

From the result of various analyses of the toner particle, it is found that the relationship between the total amount of the wax measured according to the above-noted DSC method and the ratio of the two peak strengths ($P_{2850}/P_{828}$) measured according to the FTIR-ATR method was varied depending on the dispersion condition of the wax in the toner particle due to the difference in the manufacturing method of the toner particle. In the toner according to the present invention as a preferred aspect of the present invention which is produced by subjecting a material liquid for producing the toner, which is a dispersion in which at least a polyester prepolymer having a functional group containing a nitrogen atom, a polyester resin, a colorant and a releasing agent are dispersed in an organic solvent, to at least one of a crosslinking reaction and an elongation reaction in an aqueous medium under the presence of resin fine particles, the wax is not present in the outermost surface of the toner particle and dispersed uniformly in the toner particle. By changing the total amount of the wax which is present in the whole toner particle, the above-noted relationship between the total amount of the wax which is present in the whole toner particle and the ratio of the two peak strengths ($P_{2850}/P_{828}$) is analyzed and the result of the analysis is as follows. When the total amount of the wax which is present in the whole toner particle is small, the amount of the wax which is present in the near of the surface of the toner particle which is represented by the two peak strengths ratio ($P_{2850}/P_{828}$) is constantly 0 and when the total amount of the wax which is present in the whole toner particle becomes more than a certain value, the elevation of the ratio of the two peak strengths ($P_{2850}/P_{828}$) is observed. This phenomenon is a backing evidence for such a fact that the wax in the toner particle is not dispersed selectively in the near of the surface of the toner particle, but is dispersed uniformly in an inside portion of the toner particle which is distant from the outermost surface of the toner particle. Further, since the wax which is present in a portion of the toner particle and located around the depth of 0.3 μm in the toner particle is easily oozed out to the surface of the toner particle, the toner can exhibit effectively the releasing properties.

The total amount of the wax which is present in the whole toner particle (which is measured according to the DSC method) is 3% by mass to 21% by mass, preferably 3% by mass to 20% by mass, based on the mass of the toner particle. When the total amount of the wax is less than 3% by mass, the total amount of the wax which is present in the whole toner particle is too small and the toner particle cannot obtain satisfactory releasing properties during fixing an image, so that the hot-offset resistance of the toner is lowered. On the other hand, when the total amount of the wax is more than 21% by mass, the blocking resistance of the toner is lowered or with respect to the color image, and the glossiness of the fixed image is impaired.

The relative amount of the wax which is present in the near of the surface of the toner particle (which is measured according to the FTIR-ATR method) in terms of the ratio between the two peak strengths ($P_{2850}/P_{828}$) is preferably 0.01 to 0.40. When the ratio between the two peak strengths is less than 0.01, the wax is present in the near of the surface of the toner particle in a small amount, so that the toner particle cannot obtain satisfactory releasing properties during fixing an image. On the other hand, when the ratio between the two peak strengths is more than 0.40, it is not preferable that the amount of the wax which is present in the near of the surface of the toner particle increases and the wax is easily oozed out to the outermost surface of the toner particle. For improving the compatibility between the hot-offset resistance of the toner and the charging properties, developing properties and blocking resistance of the toner during fixing an image, the ratio between the two peak strengths is more preferably 0.03 to 0.30.

Whether at least a part of the wax is present in the toner particle as plural independent wax dispersion particles involved in the toner particle or not and the dispersion condition of the wax in the toner particle were observed by using a TEM (transmission electron microscope). More specifically, the observation of the toner particle was performed according to a method in which the sample of the toner particle was embedded in an epoxy resin, slicing the epoxy resin to a section having a thickness of about 100 μm, dying the section with ruthenium tetraoxide and observing the cross section of the toner particle embedded in the epoxy resin using the TEM at the enlarging magnification of 10,000. The TEM photograph of the cross section of the toner particle according to the present invention is shown in FIG. 1. From this TEM photograph, it is found that the wax is not only dispersed in the near of the surface of the toner particle, but also dispersed uniformly in the inside of the toner particle. By dispersing the wax in the toner particle under the above-noted dispersion condition, even when the amount of the wax which is present in the toner particle is small, not only the hot-offset resistance of the toner can be effectively improved, but also the lowering of the charging properties, developing properties and blocking resistance of the toner can be prevented.

The wax dispersion particles are dispersed preferably uniformly in the toner particle. Here, "the wax particles are dispersed uniformly" means "plural wax dispersion particles are dispersed in the toner particle without a large localization of the wax particles". For example, it is also preferred that in a random cross section of the toner particle which includes the center of the toner particle, the number of the wax dispersion particles which are present within a concentric circle of the outer circle of the above-noted cross section of the toner particle, wherein the concentric circle has a diameter which is ⅔ time the diameter of the outer circle is more than 30% and 60% or less, based on the number of the wax dispersion particles which are present in the whole surface of the above-noted cross section of the toner particle.

The surface area of the wax which is present in the outermost surface of the toner particle is preferably 5% or less, based on the area of the outermost surface of the toner particle.

In the toner according to the present invention, as noted above, the wax is dispersed in the toner particle and further, the toner particle has a path through which the wax is oozed out to the surface of the toner particle when the toner is heated and pressed by a fixing member. In other words, by deforming the toner particle through heating and pressing the toner during fixing an image, the wax which is dispersed in the toner particle is oozed out to the surface of the toner particle. According to the above-noted structure of the toner particle, the hot-offset resistance of the toner can be improved without impairing the charging properties, fluidity and blocking resistance of the toner.

Figure 2:
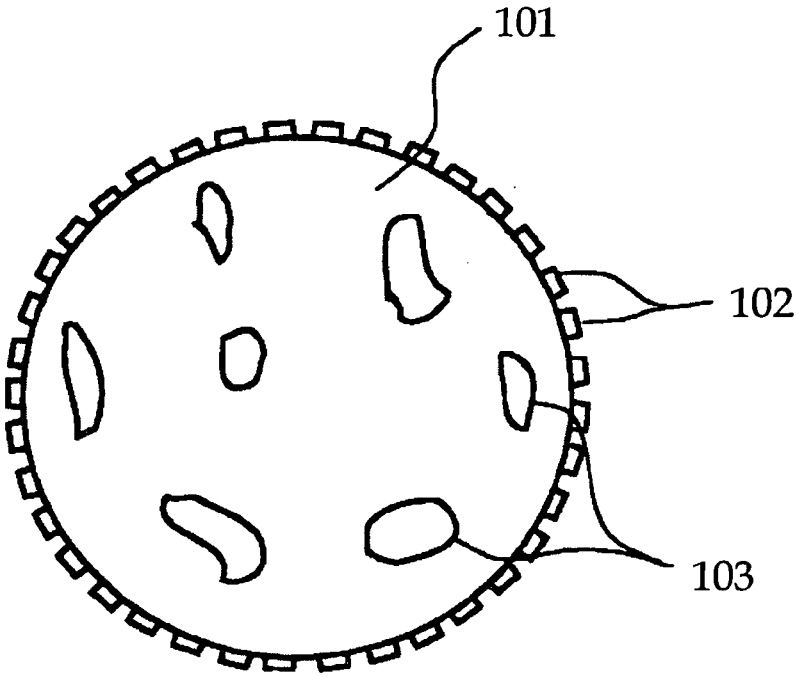
FIG. 2 is a section view schematically showing an example of the cross section of the toner according to the present invention.

FIG. 2 is a sectional view schematically showing an example of the cross section of the toner particle according to the present invention. For example, as shown in FIG. 1, the surface of the toner base particle 101 is coated and fixed with the resin fine particle 102. The method for coating and fixing the surface of the toner base particle 101 with the resin fine particle 102 is not restricted and examples of the method include a method in which the surface of the toner particle is coated with the resin fine particle having a fine diameter and the resin fine particle is fused to the surface of the toner particle by heating and a method in which the surface of the toner particle is coated with the resin fine particle in a liquid. The resin fine particle 102 which is fused to the surface of the toner particle functions as a reliable spacer through a void occurred between the toner particle and the resin fine particle. When the toner particle is deformed by applying heat and pressure to the toner particle during fixing an image, by the above-noted function as a spacer, the path through which the wax 103 which is present in the inside of the toner particle is oozed out to the surface of the toner particle is generated and then, the wax 103 can be oozed out to the surface of the toner particle. In other words, the wax 103 is oozed out to the surface of the tone particle only during fixing an image, so that in other steps, for example in developing, a disadvantage, such as the lowering of the charging properties of the toner due to the oozing out of the wax 103 to the surface of the toner particle can be dissolved.

The wax can attain the object thereof through such a function that the wax is smoothly oozed out to the surface of the toner particle during fixing an image. Since when a wax having a high acid value is used, the function of the wax as a releasing agent is lowered, for securing the function as a releasing agent, it is particularly preferred that a carnauba wax from which a free fatty acid is eliminated, rice wax, montan ester wax or ester wax which have an acid value of 5 KOH mg/g or less is used. These waxes may be used individually or in combination.

For controlling the fixing properties, particularly hot-offset properties and paper-winding-around properties of the toner, the above-noted amount, type and present location of the wax are important. On the other hand, the thermal properties of the toner is also important and the controlling of the glass transition temperature (Tg) among the thermal properties of the toner is more preferred particularly from the view point of preventing the contamination (which leads to the contamination of a recording paper) of a fixing member (e.g., a fixing roller and a fixing belt) due to a slight amount of the hot offset.

The glass transition temperature (Tg) of the toner can be measured using the above-noted DSC apparatus and is measured in the present invention in terms of the glass transition temperature of so-called the second peak which is obtained according to a measuring method in which the elevation of the sample temperature from room temperature to 150° C. is repeated by two times. The toner has, from the view point of the heat resistant storage properties of the toner, a glass transition temperature (Tg) of preferably 35° C. to 60° C., more preferably 45° C. to 55° C. When the glass transition temperature of the toner is less than 35° C., the heat resistant storage properties of the toner is impaired. On the other hand, when the glass transition temperature of the toner is more than 60° C., the low temperature image fixing properties of the toner becomes unsatisfactory. The glass transition temperature (Tg) of the toner may be different from that of the resin used for coating the toner base particle and when the toner is produced by a crosslinking reaction, it becomes necessary to control particularly the glass transition temperature (Tg) of the toner. Even in the case where the crosslinking reaction is not used for producing the toner, when the toner comprises only a small amount of various additives (e.g., colorant, charge controlling agent, activator, reaction assistant, dispersant of a colorant, grinding assistant, dispersant of the wax and additive), by the plasticizing effect of these additives, the glass transition temperature (Tg) of the toner may be lowered by more temperature than a lowered temperature corresponding to the amount of the additive sometimes and therefore, the controlling of the glass transition temperature (Tg) of the toner is necessary.

Hereinbelow, with respect to other components of the composition of the toner, explanations are given.

(Modified Polyester)

The toner of the present invention comprises a modified polyester (i) as a binder resin. A modified polyester indicates a state of a polyester in which a combined group other than ester bond may reside in a polyester resin, and different resin components are combined into a polyester resin through covalent bond, ionic bond or the like. Specifically, a modified polyester is the one that a functional group, such as, an isocyanate group or the like which reacts to a carboxylic acid group and a hydrogen group, is introduced to a polyester end and further reacted to an active hydrogen-containing compound to modify the polyester end.

Examples of the modified polyester (i) include a urea modified polyester which is obtained by a reaction between a polyester prepolymer (A) having an isocyanate group and amines (B). Examples of the polyester prepolymer (A) having an isocyanate group include a polyester prepolymer which is a polycondensation polyester of a polyvalent alcohol (PO) and a polyvalent carboxylic acid (PC) and having an active hydrogen group is further reacted to a polyvalent isocyanate compound (PIC). Examples of the active hydrogen group included into the above-noted polyester include a hydroxyl group (an alcoholic hydroxyl group and a phenolic hydroxyl group), an amino group, a carboxyl group, and a mercapto group. Among these groups, an alcoholic hydroxyl group is preferable.

A urea-modified polyester is formed in the following manner.

Examples of the polyvalent alcohol compound (PO) include a divalent alcohol (DIO), and a trivalent or more polyvalent alcohol (TO), and any of a divalent alcohol (DIO) alone and a mixture of a divalent alcohol (DIO) with a small amount of a polyvalent alcohol (TO) are preferable. Examples of the divalent alcohol (DIO) include an alkylene glycol (such as, ethylene glycol, 1,2-propylene glycol, 1,3-propylene glycol, 1, 4-bytandiol, and 1,6-hexanediol); an alkylene ether glycol (such as, diethylene glycol, triethylene glycol, dipropylene glycol, polyethylene glycol, polypropylene glycol, and polytetramethylene ether glycol); an alicyclic diol (such as, 1,4-cyclohexane dimethanol, and hydrogenated bisphenol A); bisphenols (such as, bispheonol A, bisphenol F, and bisphenol S); an alkylene oxide adduct of the above-noted alicyclic diol (such as, an ethylene oxide, a propylene oxide, and a butylene oxide); and an alkylene oxide adduct of the above-noted bisphenols (such as, an ethylene oxide, a propylene oxide, and a butylene oxide). Among the above mentioned, an alkylene glycol having carbon number 2 to 12 and an alkylene oxide adduct of bisphenols are preferable, and an alkylene oxide adduct of bisphenols and a combination of the adduct with an alkylene glycol having carbon number 2 to 12 are particularly preferable. Examples of the trivalent or more polyvalent alcohol (TO) include a polyaliphatic alcohol of trivalent to octavalent or more (such as, glycerine, trimethylol ethane, trimethylol propane, pentaerythritol, and sorbitol); and trivalent or more phenols (such as, trisphenol PA, phenol novolac, and cresol novolac); and alkylene oxide adduct of the trivalent or more polyphenols.

Examples of the polyvalent carboxylic acid (PC) include a divalent carboxylic acid (DIC) and a trivalent or more polyvalent carboxylic acid (TC), and any of a divalent carboxylic acid (DIC) alone and a mixture of a divalent carboxylic acid (DIC) with a small amount of a polyvalent carboxylic acid (TC) are preferable. Examples of the divalent carboxylic acid (DIC) include an alkylene dicarboxylic acid (such as, succinic acid, adipic acid, and sebacic acid); an alkenylen dicarboxylic acid (such as, maleic acid, and fumaric acid); an aromatic dicarboxylic acid (such as, phthalic acid, isophthalic acid, terephthalic acid, and naphthalene dicarboxylic acid). Among these divalent carboxylic acids, an alkenylen dicarboxylic acid having carbon number 4 to 20 and an aromatic dicarboxylic acid having carbon number 8 to 20 are preferable. Examples of the trivalent or more polyvalent carboxylic acid (TC) include an aromatic polyvalent carboxylic acid having carbon number 9 to 20 (such as, trimellitic acid, and pyromellitic acid). It is noted that as a polyvalent carboxylic acid (PC), an acid anhydride from among the polyvalent carboxylic acids or a lower alkyl ester (such as, methyl ester, ethyl ester, and isopropyl ester) may be used to react to a polyvalent alcohol (PO).

A ratio of a polyvalent alcohol (PO) to a polyvalent carboxylic acid (PC), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

Examples of the polyvalent isocyanate compound (PIC) include an aliphatic polyvalent isocyanate (such as, tetramethylen diisocyanate, hexamethylen diisocyanate, and 2, 6-diisocyanate methyl caproate); an alicyclic polyisocyanate (such as, isophorone diisocyanate, and cyclohexyl methane diisocyanate); an aromatic diisocyanate (such as, tolylene diisocyanate, and diphenylmethane diisocyanate); an aromatic aliphatic diisocyanate (α, α, α', α'-tetramethyl xylylene diisocyanate, and the like); isocyanates; a compound in which the above noted polyisocyanate is blocked with a phenol derivative, an oxime, caprolactam, and the like; and a combination of two or more elements thereof.

A ratio of a polyvalent isocyanate compound (PIC), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When [NCO]/[OH] is more than 5, low-temperature image fixing properties becomes degraded. When the molar ratio of [NCO] is less than 1, when an urea modified polyester is used, the urea content of ester becomes lower, which makes hot-offset resistance becomes degraded.

The components content of polyvalent isocyanate compound (PIC) of a polyester prepolymer having an isocyanate group (A) is typically 0.5% by mass to 40% by mass, preferably 1% by mass to 30% by mass, and more preferably 2% by mass to 20% by mass. When less than 0.5% by mass, it makes hot-offset resistance degraded and brings about disadvantages in the compatibility between heat resistant storage properties and low-temperature image fixing properties. On the other hand, when it is more than 40% by mass low-temperature image fixing properties become degraded.

The number of isocyanate groups contained in per one molecular of polyester prepolymer having isocyanate group (A) is typically 1 or more, preferably 1.5 to 3 on an average, and more preferably 1.8 to 2.5 on an average. When the number of isocyanate groups is less than 1 per 1 molecular of polyester prepolymer, the molecular mass of the urea modified polyester becomes lower, which makes hot-offset resistance degraded.

Next, examples of amines (B) to be reacted to a polyester prepolymer (A) include a divalent amine compound (B1), a trivalent or more polyvalent amine compound (B2), an aminoalcohol (B3), an amino mercaptan (B4), an amino acid (B5), and an compound in which the amino group of B1 to B5 is blocked (B6).

Examples of the divalent amine compound (B1) include an aromatic diamine (such-as, phenylene diamine, diethyl toluene diamine, 4,4'-diamino diphenyl methane); an alicyclic diamine (4,4'-diamino-3,3'-dimethyl dicyclohexyl methane, diamine cyclohexane, and isophorone diamine); and an aliphatic diamine (such as, ethylene diamine, tetramethylene diamine, and hexamethylene diamine). Examples of the trivalent or more polyvalent amine compound (B2) include diethylene triamine, and triethylene tetramine. Examples of the aminoalcohol (B3) include ethanol amine, and hydroxyethylaniline. Examples of the amino mercaptan (B4) include aminoethyl mercaptan, and aminopropyl mercaptan. Examples of the amino acid (B5) include aminopropionic acid, aminocaproic acid, and the like. Examples of the compound in which the amino group of B1 to B5 is blocked (B6) include a ketimine compound obtained from the above-noted amines of B1 to B5 and ketones (such as, acetone, methyl ethyl ketone, and methyl isobuthyl ketone) and oxazolidine compound, and the like. Among these amines (B), a divalent amine compound B1 and a mixture of B1 with a small amount of a trivalent or more polyvalent amine compound (B2) are preferable.

A ratio of amines (B), defined as an equivalent ratio [NCO]/[NHx] of isocyanate group [NCO] in a polyester prepolymer having isocyanate group (A) to amine group [NHx] in amines (B), is typically 1/2 to 2/1, preferably 1.5/1 to 1/1.5, and more preferably 1.2/1 to 1/1.2. When [NCO]/[NHx] is more than 2 or less than 1/2, the molecular mass of urea modified polyester becomes lower, which makes hot-offset resistance degraded.

In addition, the urea modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, hot-offset resistance becomes degraded.

A modified polyester (i) used in the present invention is manufactured by one-shot method, and prepolymer method. The mass-average molecular mass of the modified polyester (i) is typically 10,000 or more, preferably 20,000 to 10,000,000 and more preferably 30,000 to 1,000,000. The molecular mass peak at the time is preferably 1,000 to 10,000, and when less than 1,000, it is hard to be subjected to elongation reactions, and the toner's elasticity is low, which makes hot-offset resistance become degraded. When the molecular mass peak is more than 10,000, it may cause degradation of fixability and may bring hard challenges in manufacturing in yielding fine particles of toner and in toner grinding. The number average molecular mass of the modified polyester (i) when used together with an unmodified polyester (ii), which will be hereafter described, is not particularly limited, and it may be a number average molecular mass which is easily obtained to be used with the above-noted mass average molecular mass. When a modified polyester (i) is used alone, the number average molecular mass is typically 20,000 or less, preferably 1,000 to 10,000, and more preferably 2,000 to 8,000. When the number average molecular mass is more than 20,000, low-temperature image fixing properties and gross properties when used in a full-color device become degraded.

In crosslinking and/or elongation reactions of a polyester prepolymer (A) and amines (B) in order to obtain a modified polyester (i), a reaction stopper may be used as required to control the molecular mass of a urea modified polyester to be obtained. Examples of the reaction stopper include a monoamine (such as, diethyl amine, dibutyl amine, buthyl amine, and lauryl amine), and a compound in which the above-noted elements are blocked (ketimine compound).

It is noted that the molecular mass of a polymer to be formed can be measured by means of gel permeation chromatography (GPC), using a tetrahydrofuran (THF) solvent.

(Unmodified Polyester)

In the present invention, not only the modified polyester (i) may be used alone but also an unmodified polyester (ii) may be included together with the modified polyester (i) as binder resin components. Using an unmodified polyester (ii)

in combination with a modified polyester (i) is preferable to the use of the modified polyester (i) alone, because low-temperature image fixing properties and gloss properties when used in a full-color device become improved. Examples of the unmodified polyester (ii) include a polycondensation polyester of a polyvalent alcohol (PO) and a polyvalent carboxylic acid (PC), and the like, same as in the modified polyester (i) components. Preferable compounds thereof are also the same as in the modified polyester (i). As for the unmodified polyester (ii), in addition to an unmodified polyester, it may be a polymer which is modified by a chemical bond other than urea bonds, for example, it may be modified by a urethane bond. It is preferable that at least part of a modified polyester (i) is compatible with part of an unmodified polyester (ii), from the aspect of low-temperature image fixing properties and hot-offset resistance. Thus, it is preferable that the composition of the modified polyester (i) is similar to that of the unmodified polyester (ii). A mass ratio of a modified polyester (i) to an unmodified polyester (ii) when an unmodified polyester (ii) being included, is typically 5/95 to 80/20, preferably 5/95 to 30/70, more preferably 5/95 to 25/75, and still more preferably 7/93 to 20/80. When the mass ratio of a modified polyester (i) is less than 5%, it makes hot-offset resistance degraded and brings about disadvantages in compatibility between heat resistant storage properties and low-temperature image fixing properties.

The molecular mass peak of the unmodified polyester (ii) is typically 1,000 to 10,000, preferably 2,000 to 8,000, and more preferably 2,000 to 5,000. When the molecular mass peak of the unmodified polyester (ii) is less than 1,000, heat resistant storage properties becomes degraded, and when more than 10,000, low-temperature image fixing properties becomes degraded. The hydroxyl value of the unmodified polyester (ii) is preferably 5 or more, more preferably 10 to 120, and still more preferably 20 to 80. When the value is less than 5, it brings about disadvantages in the compatibility between heat resistant storage properties and low-temperature image fixing properties. The acid number of the unmodified polyester (ii) is preferably 1 to 5, and more preferably 2 to 4. Since a wax with a high acid value is used, as for a binder, a binder with a low acid value is easily matched with a toner used in a two-component developer, because such a binder leads to charging and a high volume resistivity.

The glass transition temperature (Tg) of the binder resin is typically 35° C. to 70° C., and preferably 55° C. to 65° C. When less than 35° C., toner's heat resistant storage properties becomes degraded, and when more than 70° C., low-temperature image fixing properties becomes insufficient. The toner of the present invention shows a proper heat resistant storage properties tendency even with a low glass transition temperature, compared to a toner made from a polyester known in the art, because a urea modified polyester easily exists on the surface of the toner base particles to be obtained.

(Colorant)

With respect to the colorant to be used, all the dyes and pigments known in the art may be used. For example, it is possible to use carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthraene yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and a mixture thereof. The colorant content of the toner is typically 1% by mass to 15% by mass, and preferably 3% by mass to 10% by mass.

The colorant may be used as a master batch compounded with a resin. Examples of the binder resin to be used in manufacturing of a master batch, or to be kneaded with a master batch include a styrene such as, polystyrene, poly-p-chlorostyrene, polyvinyl toluene, and a derivative substitution polymer thereof, or a copolymer of the above-noted styrene and a vinyl compound, polymethyl methacrylate, polybutyl methacrylate, polyvinylchloride, polyvinyl acetate, polyethylene, polypropylene, polyester, an epoxy resin, an epoxy polyol resin, polyurethane, polyamide, polyvinyl butyral, a polyacrylic acid resin, rodin, a modified-rodin, a terpene resin, an aliphatic hydrocarbon resin, an alicyclic hydrocarbon resin, an aromatic petroleum resin, chlorinated paraffin, and paraffin wax. Each of these colorants may be employed alone or in combination of two or more.

The master batch may be obtained by applying a high shearing force to a resin and a colorant for master batch and by mixing and kneading the components. Here, to improve the interaction between the resin and the colorant, an organic solvent can be used. Besides, a so-called flashing process is preferably used in manufacturing a mater batch, because in the flashing process, a wet cake of a colorant can be directly used without the necessity of drying. In the flashing process, a colorant's water paste containing water is mixed and kneaded with a resin and an organic solvent to transfer the colorant to the resin and then to remove the moisture and the organic solvent component. For mixing or kneading as above, a high shearing dispersion device such as a triple roll mill is preferably used.

(Charge Controlling Agent)

As a charge controlling agent, a conventional one in the art can be used. Examples of the charge controlling agent include a nigrosine dye, a triphenylmethane dye, a chrome-contained metal-complex dye, a molybdic acid chelate pigment, a rhodamine dye, an alkoxy amine, a quaternary ammonium salt (including a fluoride-modified quaternary ammonium salt), an alkylamide, a phosphoric simple substance or a compound thereof, a tungsten simple substance or a compound thereof, a fluoride activator, a salicylic acid metallic salt, and a salicylic acid derivative metallic salt. Specifically, Bontron 03 being a nigrosine dye, Bontron P-51 being a quaternary ammonium salt, Bontron S-34 being a metal containing azo dye, Bontron E-82 being an oxynaphthoic acid metal complex, Bontron E-84 being a salicylic acid metal complrex, and Bontron E-89 being a phenol condensate (manufactured by Orient Chemical Industries, Ltd.); TP-302 and TP-415 being a quaternary ammonium salt molybdenum metal complex (manufactured by HODOGAYA CHEMICAL CO., LTD.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (manufactured by Hoechst Ltd.); LRA-901, and LR-147 being a boron metal complex (manufactured by Japan Car1it Co., Ltd.), copper phtalocyamine, perylene, quinacridone, an azo pigment, and other high-molecular mass compounds having a functional group, such as a sulfonic acid group, a carboxyl group, and a quaternary ammonium salt. Among the charge controlling agents, a substance capable of controlling a toner to a negative polarity is preferably used. The usage of the charge controlling agent is determined depending on the type of a binder resin, presence or absence of an additive to be used as required, and the method for manufacturing a toner including a dispersion process and is not limited uniformly, however, to 100 parts by mass of binder resin, 0.1 parts by mass to 10 parts by mass of the charge controlling agent is preferably used and more preferably with 0.2 parts by mass to 5 parts by mass of the charge controlling agent. When the charge controlling agent is more than 10 parts by mass, toner's charge properties are exceedingly large, which lessens the effect of the charge controlling agent itself and increases in electrostatic attraction force with a developing roller, and causes degradations of developer's fluidity and image density.

(External Additives)

As an external additive for assisting in fluidity of toner particles, developing properties, and charge properties, inorganic particles are preferably used. A first-order particle diameter of the inorganic particles is preferably $5\times10^{-3}$ μm to 2 μm and more preferably $5\times10^{-3}$ μm to 0.5 μm. A specific surface according to BET equation is preferably 20 $m^2/g$ to 500 $m^2/g$. A proportion of the usage of the organic particles is preferably 0.01% by mass to 5% by mass of the toner amount and more preferably 0.01% by mass to 2.0% by mass of the toner amount.

Specifically, examples of the inorganic particles include silica, alumina, a titanium oxide, barium titanate, magnesium titanate, calcium titanate, strontium titanate, a zinc oxide, a tin oxide, silica sand, clay, mica, wallastonite, silious earth, a chromium oxide, a ceric oxide, colcothar, an antimony trioxide, a magnesium oxide, a zirconium oxide, barium sulfate, barium carbonate, calcium carbonate, silicon carbide, and silicon nitride.

Besides the above-mentioned, polymer particles, such as, polymer particles made from a polystyrene copolymer, a methacrylic acid ester copolymer, and an acrylic acid ester copolymer obtained by a soap-free emulsion polymerization, a suspension polymerization, and a dispersion polymerization; and condensation polymers such as silicon, benzoguanamine, and nylon, and a thermosetting resin.

The above-noted external additives enable preventing deteriorations of fluidity and charge properties of the toner even under high-humidity environment by performing surface finishing thereof to improve hydrophobic properties. Examples of preferable finishing agents include a silane coupling agent, a sililation reagent, a silane coupling agent having a fluorinated alkyl group, an organic titanate coupling agent, an aluminum coupling agent, silicon oil, and a modified silicon oil. Particularly, it is preferable to use hydrophobic silica and a hydrophobic titanium oxide obtained by performing the above-noted surface finishing on silica and a titanium oxide.

Next, a method for manufacturing a toner will be described. Here, a preferred example of the method will be explained; however, it is not limited to the disclosed method.

(Method for Manufacturing a Toner Binder)

A toner binder may be manufactured by the following method, and the like. A polyvalent alcohol (PO) and a polyvalent carboxylic acid (PC) are heated to a temperature of 150° C. to 280° C. in the presence of an esterification catalyst known in the art, such as, tetrabutoxy titanate, and a dibutyltin oxide, and yielded water was removed while depressurizing as needed to obtain a polyester having a hydroxyl group. Next, the obtained polyester is reacted to a polyisocyanate compound (PIC) at a temperature of 40° C. to 140° C. to obtain a prepolymer having an isocyanate group (A). Further, the prepolymer (A) is reacted to amines (B) at a temperature of 0° C. to 140° C. to obtain a modified polyester with urea bond.

On the occasion of reacting a polyisocyanate compound (PIC) and the occasion of reacting the prepolymer (A) to amines (B), a solvent may be used if needed. Examples of available solvents include a solvent which is inactive to a polyisocyanate compound (PIC), such as, an aromatic solvent (such as, toluene, and xylene); a ketone (such as, acetone, methyl ethyl ketone, and methyl isobutyl ketone); an ester (such as, ethylacetate); an amide (such as, dimethylformamide, and dimethylacetamide); and ether (such as, tetrahydrofuran) which are inactive with the polyvalent isocianate compound (PIC).

When an unmodified polyester (ii) is used in combination with the modified polyester, an unmodified polyester (ii) is manufactured in a similar manner as the polyester having a hydroxyl acid group, and the obtained polyester is melted into a solvent which has been subjected to the reactions as in the modified polyester and then mixed.

(Method for Manufacturing a Toner)

1) A colorant, an unmodified polyester (i), a polyester prepolymer having an isocyanate group (A), a releasant, and inorganic filler are dispersed into an organic solvent to prepare a toner material-contained solution.

As to the organic solvent, an organic solvent being volatile with a boiling point of 100° C. or less is preferable in terms of ease of removability after toner base particles being formed. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone and the like may be used alone or in combination with two or more. Particularly, an aromatic solvent, such as, toluene, xylene, and a halogenated hydrocarbon, such as, 1,2-dichloroethane, chloroform, carbon tetrachloride, are preferable. The mount of the organic solvent to 100 parts by mass of the polyester prepolymer is typically 0 part by mass to 300 parts by mass, preferably 0 part by mass to 100 parts by mass, and more preferably 25 parts by mass to 70 parts by mass.

2) The toner material-contained solution is emulsified in an aqueous medium in the presence of a surfactant and resin fine particles. The aqueous medium may be water alone or may comprise an organic solvent made from, such as, alcohols (methanol, isopropyl alcohol, ethylene glycol, and the like); dimethylformamide; tetrahydrofuran; and Cellosolves (methyl cellosolve, and the like); and lower ketone (acetone, methyl ethyl ketone, and the like).

The amount of the aqueous medium is generally 50 parts by mass to 2,000 parts by mass, and preferably 100 parts by mass to 1,000 parts by mass relative to 100 parts by mass of the toner material-contained solution. When the amount of aqueous medium is less than 50 parts by mass, the toner material-contained solution may not be dispersed sufficiently, and the resultant toner particles may not have a predetermined average particle diameter. When it is more than 20,000 parts by mass, it is not unfavorable in terms of cost reduction.

The above-noted resin fine particles which are dispersed in the aqueous medium have a glass transition point (Tg) of preferably 50° C. to 110° C., more preferably 50° C. to 90° C., still more preferably 50° C. to 70° C. When the glass transition point of the resin fine particles is less than 50° C., the shelf stability of the toner is impaired or the toner is adhered or agglomerated with a high provability in a route through which the toner is recovered during the recycling of the toner. On the other hand, when the glass transition point of the resin fine particles is more than 110° C., the resin fine particles hinder the adhesion of the toner to the fixing paper, so that the lower limit temperature for the fixing is elevated. The resin fine particle has a mass-average molecular mass of preferably 100,000 or less, more preferably 50,000 or less. The lower limit of the mass-average molecular mass of the resin fine particle is generally 4,000. When the mass-average molecular mass is more than 100,000, the resin fine particles hinder the adhesion of the toner to the fixing paper, so that the lower limit of the fixing temperature of the toner is elevated. The resin fine particles are not restricted so long as the resin fine particles can form an aqueous dispersion thereof and may be selected from conventional resin fine particles, such as fine particles of a thermoplastic resin and a thermosetting resin. Specific examples of the resin fine particles include fine particles of a vinyl resin, a polyurethane resin, an epoxy resin and a polyester resin. These resin fine particles may be used individually or in combination. Among them, from the viewpoint of easiness for obtaining an aqueous dispersion of resin particles in the form of an ultra fine sphere, fine particles of a vinyl resin, polyurethane resin, epoxy resin, polyester resin and a mixture thereof are preferred.

Examples of the vinyl resin include a polymer produced by polymerizing or copolymerizing a vinyl monomer, such as a styrene-acrylic ester resin, a styrene-methacrylic ester resin, a styrene-butadiene copolymer, an acrylic acid-acrylic ester resin, a methacrylic acid-acrylic ester resin, a styrene-acrylonitrile copolymer, a styrene-maleic anhydride copolymer, a styrene-acrylic acid copolymer and a styrene-methacrylic acid copolymer.

The resin fine particle has a volume average particle diameter of 10 nm to 200 nm, preferably 20 nm to 80 nm, wherein the volume average particle diameter is measured using a light scattering spectrophotometer (manufactured by Otsuka Electronics CO., Ltd.).

Where necessary, a dispersing agent such as surfactants and resin fine particles can be used for better particle size distribution and more stable dispersion in the aqueous medium.

Examples of the surfactant include an anionic surfactant, such as an alkylbenzene sulfonic acid salt, a α-olefin sulfonic acid salt and a phosphoric ester; a cationic surfactant, such as an amine salt, such as an alkyl amine salt, an aminoalcohol aliphatic acid derivative, a polyamine aliphatic acid derivative and an imidazoline, and a quaternary ammonium salt, such as an alkyltrimethyl ammonium salt, a dialkyldimethyl ammonium salt, an alkyldimethylbenzyl ammonium salt, a pyridinium salt, an alkylisoquinolinium salt and a benzethonium chloride; a nonionic surfactant, such as an aliphatic amide derivative and a polyhydric alcohol derivative; and an ampholitic surfactant, such as alanine, dodecyldi(aminoethyl) glycine, di(octylaminoethyl) glycine and N-alkyl-N,N-dimethyl ammonium betain.

By using a surfactant having a fluoroalkyl group even in an extremely small amount, the effect as a surfactant can be advantageously obtained. Preferred examples of the anionic surfactant having a fluoroalkyl group include a $C_2$ to $C_{10}$ fluoroalkyl carboxylic acid and a metal salt thereof, perfluorooctanesulfonylglutamic acid disodium, a 3-[ω-fluoroalkyl ($C_6$ to $C_{11}$) oxy]-1-alkyl ($C_3$ to $C_4$) sulfonic acid sodium, a 3-[ω-fluoroalkanoyl ($C_6$ to $C_8$)-N-ethyamino]-1-propanesulfonic acid sodium, a fluoroalkyl ($C_{11}$ to $C_{20}$) carboxylic acid and a metal salt thereof, a perfluoroalkylcarboxylic ($C_7$ to $C_{13}$) acid and a metal salt thereof, a perfluoroalkyl ($C_4$ to $C_{12}$) sulfonic acid and a metal salt thereof, a perfluorooctanesulfonic acid diethanolamide, a N-propyl-N-(2-hydroxyethyl)perfluorooctanesulfonamide, a perfluoroalkyl ($C_6$ to $C_{10}$) sulfonamidepropyltrimethyl ammonium salt, a perfluoroalkyl ($C_6$ to $C_{10}$)-N-ethylsulfonyl glycine salt and a monoperfluoroalkyl ($C_6$ to $C_{16}$) ethylphosphoric acid ester.

Examples of the commercially available anionic surfactant having a fluoroalkyl group include Surflon S-111, S-112 and S-113 (trade names, manufactured by Asahi Glass Co., Ltd.), Fluorad FC-93, FC-95, FC-98 and FC-129 (trade names, manufactured by Sumitomo 3M Limited), Unidyne DS-101 and DS-102 (trade names, manufactured by Daikin Industries, Ltd.), Megafac F-110, F-120, F-113, F-191, F-812 and F-833 (trade names, manufactured by Dainippon Ink & Chemicals, Incorporated), Eftop EF-102, 103, 104, 105, 112, 123A, 123B, 306A, 501, 201 and 204 (trade names, manufactured by JEMCO Inc.) and Ftergent F-100 and F-150 (trade names, manufactured by Neos Co., Ltd.).

Examples of the cationic surfactant include an aliphatic quaternary ammonium salt, such as an aliphatic primary, secondary and tertiary amine acid each of which has a fluoroalkyl group and a perfluoroalkyl ($C_6$–$C_{10}$) sulfonamide propyltrimethylammonium salt; a benzalkonium salt; a benzethonium chloride; a pyridinium salt; and an imidazolinium salt. Examples of the commercially available cationic surfactant include Surflon S-121 (trade name, manufactured by Asahi Glass Co., LTD.), Fluorad FC-135 (trade name, manufactured by Sumitomo 3M Limited), Unidyne DS-202 (trade name, manufactured by Daikin Industries, LTD.), Megaface F-150 and F-824 (trade name, manufactured by Dainippon Ink & Chemicals, Incorporated), Eftop EF-132 (trade name, manufactured by JEMCO Inc.) and Ftergent F-300 (trade name, manufactured by Neos Co., Ltd.).

The resin fine particles are charged into the aqueous medium for stabilizing the toner base particles produced in the aqueous medium or for preventing the oozing-out of the wax to the outermost surface of the toner base particle. To this end, it is preferable to add resin fine particles so that each toner base particle has a surface coverage of 10% to 90%. Examples of the resin fine particles include fine particles of a polymethacrylate methyl resin having a diameter of 1 μm or 3 μm, fine particles of a polystyrene resin having a diameter of 0.5 μm or 2 μm and fine particles of a poly(styrene-acrylonitrile) having a diameter of 1 μg/m. Examples of the commercially available fine resin particles include PB-200H (trade name, manufactured by Kao Corporation), SGP (trade name, manufactured by Souken Co., Ltd.), Techno Polymer SB (trade name, manufactured by Sekisui Plastics Co., Ltd.), SGP-3G (trade name, manufactured by Souken Co., Ltd.) and Micro Pear1 (trade name, manufactured by Sekisui Fine Chemicals Co., Ltd.).

Here, instead of the resin fine particles, an inorganic compound dispersant, such as tricalcium phosphate, calcium carbonate, titanium oxide, a colloidal silica and a hydroxyapatite.

Further, by charging a polymeric protective colloid into the toner dispersion as a dispersant which can be used in combination with the above-noted resin fine particles or inorganic compound dispersant, the drop of the toner dispersion may be stabilized.

Examples of the polymeric protective colloid include a colloid of a homopolymer or copolymer produced by polymerizing or copolymerizing a monomer, such as an acid, such as acrylic acid, methacrylic acid, α-cyanoacrylic acid, α-cyanomethacrylic acid, itaconic acid, crotonic acid, fumaric acid, maleic acid and maleic anhydride; a (meth) acrylic monomer having a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerine monoacrylate, glycerine monomethacrylate, N-methylolacrylamide, and N-methylolmethacrylamide; a vinyl alcohol or an ether thereof, such as vinyl methyl ether, vinyl ethyl ether and vinyl propyl ether; an ester of a vinyl alcohol and a compound having a carboxyl group, such as vinyl acetate, vinyl propionate and vinyl butyrate; an amide, such as acrylamide, methacrylamide and diacetone acrylamide; a methylol compound of the above-noted amide; an acid chloride, such as acrylic acid chloride and methacrylic acid chloride; a nitrogen-containing compound, such as vinylpyridine, vinylpyrrolidone, vinylimidazole and ethyleneimine; and the nitrogen-containing compound having a heterocyclic ring. Further, examples of the polymeric protective colloid include a colloid of a polyoxyolefin resin, such as a polyoxyethylene resin, a polyoxypropylene resin, a polyoxyethylenealkylamine resin, a polyoxypropylenealkylamine resin, a polyoxyethylenealkylamide resin, a polyoxypropylenealkylamide resin, a polyoxyethylenenonylphenylether resin, a polyoxyethylenelaurylphenylether resin, a polyoxyethylenestearylphenylester resin and a polyoxyethylenenonylphenylester resin; and a cellulose, such as a methyl cellulose, a hydroxyethyl cellulose and a hydroxypropyl cellulose.

The dispersing method is not restricted. Examples of the dispersing method include a conventional dispersing method, such as a low speed shearing method, a high speed shearing method, a friction method, a high-pressure jet method and an ultrasonic method. Among them, for rendering the diameter of the dispersed particle 2 μm to 20 μm, the high speed shearing method is preferred. In the case of the high speed shearing method, the rotation number is not restricted, however, is generally 1,000 rpm to 30,000 rpm, preferably 5,000 rpm to 20,000 rpm and the dispersing time is also not restricted, however, is generally 0.1 minute to 5 minutes in the case of a batch manner. The dispersing temperature is generally 0° C. to 150° C. (under a super atmospheric pressure), preferably 40° C. to 98° C.

3) During the preparing of the above-noted emulsion, the amine (B) is charged into the emulsion for reacting the amine (B) with the polyester prepolymer having an isocyanate group (A).

The reaction comprises the crosslinking reaction and/or elongation reaction of the molecule chain. The reaction time is selected depending on the reactivity between the isocyanate group structure of the polyester prepolymer (A) and the amine (B) and is generally 10 minutes to 40 hours, preferably 2 hours to 24 hours. The reaction temperature is generally 0° C. to 150° C., preferably 40° C. to 98° C. Further optionally, a conventional catalyst can be used. Specific examples of the conventional catalyst include dibuytltin laurate and dioctyltin laurate.

4) After the completion of the crosslinking reaction and/or elongation reaction, the organic solvent is removed from the emulsion-dispersion (reaction product) and the reaction product is washed and dried, thereby yielded the toner base particles.

For removing the organic solvent, the temperature of the whole dispersion is gradually elevated while stirring the dispersion with keeping in a laminar flow condition and when the temperature of the dispersion has reached a specified temperature, the dispersion is stirred vigorously for distilling off the solvent, thereby yielded the toner base particle in the form of a spindle. In the case where a dispersion stabilizer, such as calcium phosphate which is soluble in an acid or an alkali, calcium phosphate is removed from the toner base particle by dissolving calcium phosphate with an acid, such as hydrochloric acid and by washing the toner base particle with water. Calcium phosphate can be also removed by decomposing calcium phosphate using an enzyme.

5) In the above-obtained toner base particles, a charge controlling agent is incorporated and next, to the toner base particles the inorganic fine particles, such as silica fine particles and titanium oxide fine particles are added as an external additive, thereby yielded the toner particles according to the present invention.

The incorporation of the charge controlling agent and the external-addition of the inorganic fine particles are performed according to a conventional method using a mixer or the like.

According to the above-noted production method of the toner particles according to the present invention, the toner particle having a fine particle diameter and a sharp particle diameter distribution can be easily obtained. Further, by stirring the toner particles dispersion vigorously during the above-noted removal of the organic solvent, the form of the toner particle can be controlled to a form in the range of from a round sphere to a rugby ball and the morphology of the surface of the toner particle can be controlled to from a smooth surface to a surface having a little wrinkle.

(Distribution of Particle Diameter)

The toner particle has a volume average particle diameter (Dv) of 3.0 μm to 8.0 μm and a ratio (Dv/Dn) of the volume average particle diameter (Dv) to the number average particle diameter (Dn) of 1.00 to 1.40. By producing the toner particle having a Dv of preferably 3.0 μm to 6.0 μm and a DV/Dn of preferably 1.00 to 1.15, the toner particle which is excellent in every of heat resistant storage properties, low temperature image fixing properties and hot-offset resistance and particularly which is excellent in the glossiness of the image, when the toner particle is used in a full-color copying machine, can be obtained. It is generally said that the smaller the diameter of the toner particle is, the more advantageous for forming an image having a high resolution and a high image quality is; however, on the contrary, the small diameter of the toner particle is disadvantageous in the transfer properties and cleaning properties of the toner. Further, in the case where the volume average particle diameter of the toner particle is smaller than the minimum in the range of the volume particle diameter of the toner particle according to the present invention, when a two-component developer produced using the above-noted toner particle is stirred for a long period in the developing apparatus, the toner particle is fused to the surface of the carrier, so that the charging ability of the carrier is lowered and when a single-component developer produced by using the above-noted toner particle is used, the filming of the toner to the developing roller and the fusion of the toner to a member, such as a blade for making a thin layer of the toner are easily caused.

Further, such a phenomenon depends largely on the content of fine particles in the whole toner particles, and particularly when the content of a toner particle having a diameter of 3 μm or less in the whole toner particle is more than 10%, a disadvantage is caused that the toner particles are attached to the magnetic carrier or high stability of the charging properties of the toner can be difficultly obtained.

On the contrary, in the case where the volume average particle diameter of the toner particle is larger than the maximum in the range of the volume particle diameter of the toner particle according to the present invention, not only an image having high resolution and high image quality can be difficultly obtained, but also, when the balance between the toner inflow and toner outflow is taken, the distribution of the particle diameter of the toner particles becomes frequently large. Further, when Dv/Dn is more than 1.40, the resolution ability of the image is lowered. When the volume average particle diameter of the toner particles is less than 3.0 μm, there is concerned that the toner particle floating in the atmosphere influences the humane health. On the other hand, when the volume average particle diameter of the toner particles is more than 8.0 μm, the freshness of the toner image formed on the photoconductor is lowered and the resolution of the image is also lowered.

The average diameter and particle size distribution of the toner particles can be measured using a Coulter counter TA-II or a Coulter multisizer II (trade names, manufactured by Beckmann Coulter Inc.). In the present invention, the average diameter and particle size distribution of the toner particles were measured by using the Coulter counter TA-II, which is connected with an interface (manufactured by Nikka Giken Co., Ltd.) which outputs the data of the number distribution and the volume distribution of the toner particles, and with a personal computer (trade name: PC9801, manufactured and soled by NEC Corporation).

(Circularity)

The toner has an average circularity of preferably 0.93 to 1.00. When the circularity of the toner is less than 0.93 which is an irregular shape being far from sphere, satisfactory transfer property of the toner and an image having a high quality and no smear can be difficultly obtained. Such particles having an amorphous form have many contact points with a medium having a smooth surface, such as a photoconductor and the charge is concentrated in an ejected end portion of such particles, so that such particles have a larger attaching force through the van der Waals force or the image force than that of the particles having a relatively spherical shape. In electrostatic transferring step, therefore, irregularly formed toner particles are selectively transferred within the toner which contains irregularly formed toner particles and spherical toner particles, as a result an image missing on character or line portions is occurred. There are also problems in that the remained toner on the photoconductor has to be removed, a cleaner needs to be equipped therefor, and a toner yield (a usage ratio of the toner for forming the image) is lowered.

The circularity of the toner particle is calculated by detecting optically the toner particle and by dividing the perimeter of a cross section of the toner particle with that of a round circle having the same area as that of the cross section of the toner particle. More specifically, the measuring of the circularity is performed using a flow particle image analyzing apparatus (trade name: FPIA-2000, manufactured by Sysmex Corporation). In a specified container, 100 ml to 150 ml of water which solid impurities removed beforehand therefrom and 0.1 ml to 0.5 ml of a surfactant as a dispersant is charged, thereby yielded a surfactant mixture, followed by mixing 0.1 g to 9.5 g of the sample of the toner particle with the above-obtained mixture. The suspension in which the sample is dispersed is subjected to a dispersing treatment using an ultrasonic dispersing apparatus for about 1 minute to 3 minutes so that the dispersion density is 3,000 particles/μl to 10,000 particles/μl. Thereafter, the form and distribution of the toner particles are measured.

The toner particle according to the present invention exhibits substantially spherical shape, which may be expressed as follows.

Figure 3A:
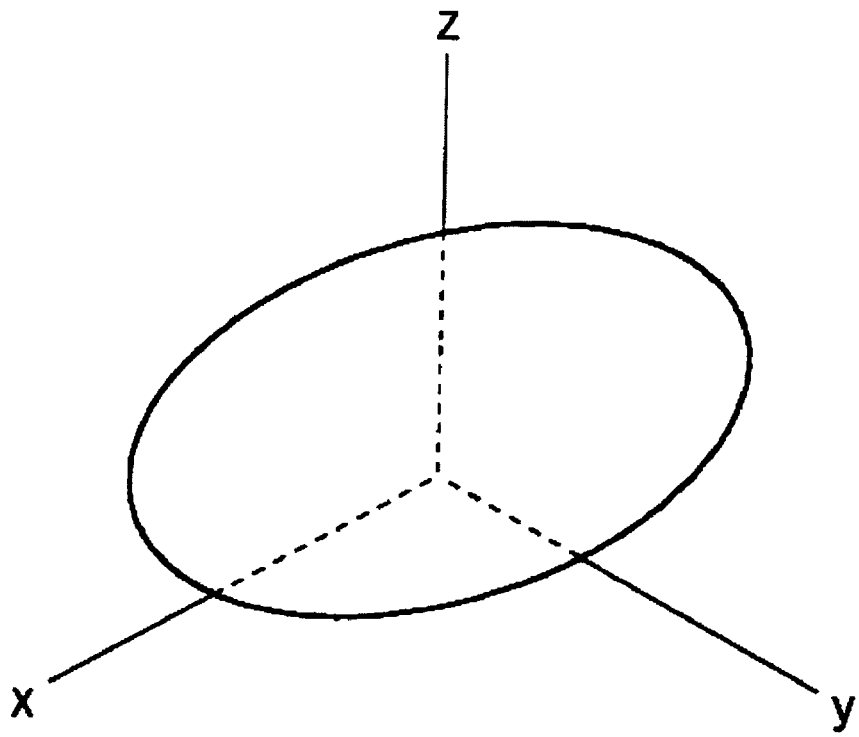
FIGS. 3A, 3B and 3C are views schematically showing an example of the form of the toner according to the present invention.
Figure 3B:
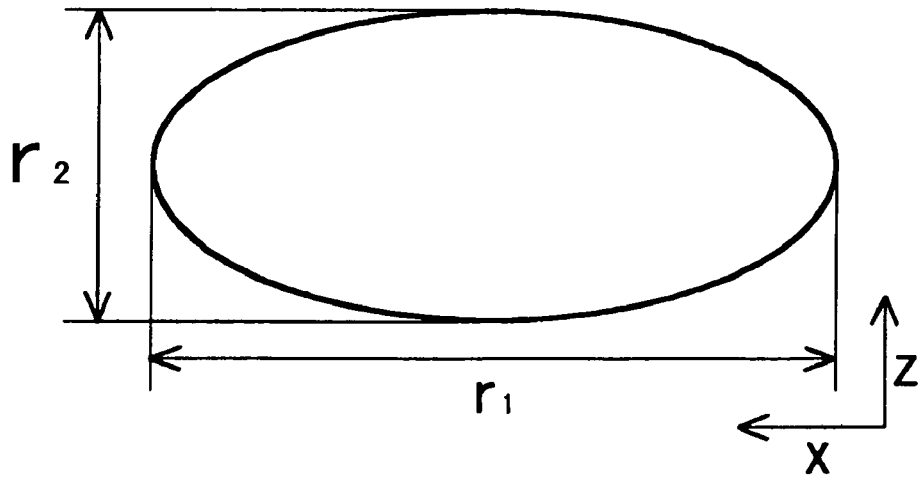
Figure 3C:
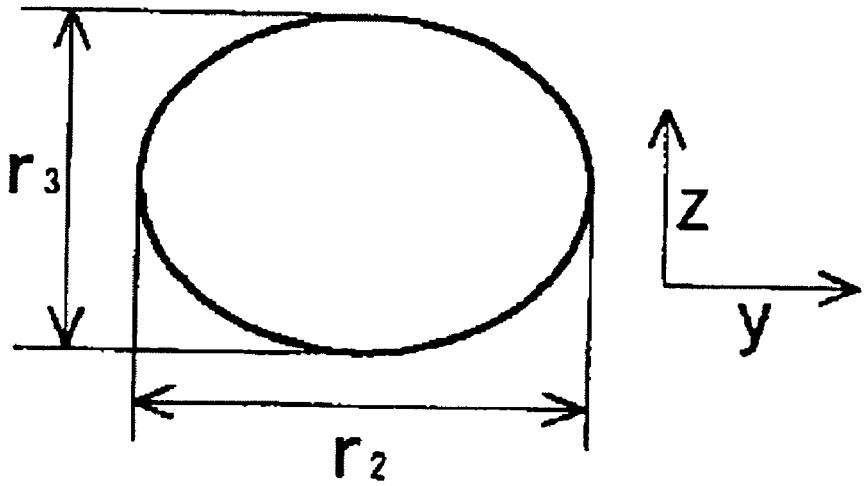

FIGS. 3A, 3B, and 3C show representative shapes of toner according to the present invention. Maximum length r1, minimum length r2, and thickness r3 are defined for the substantially spherical shape as shown in FIGS. 3A, 3B, and 3C, wherein $r1 \geqq r2 \geqq r3$. Preferably, r2/r1 is 0.5 to 1.0 (see FIG. 3B), and r3/r2 is 0.7 to 1.0 (see FIG. 3C) in the toner according to the present invention. When r2/r1 ((minimum length)÷(maximum length)) is less than 0.5, the toner tends to exhibit poor dot-reproducibility and lower transfer efficiency due to less spherical shape, hardly producing high quality images. When r3/r2 ((thickness)÷(minimum length)) is less than 0.7, the shape of the toner is almost compressed shape, thus the transfer efficiency is likely to be considerably lower than that of spherical toner. When r3/r2 is 1.0 in particular, the toner particles may act as rotatable body in which r1 acts as a rotation axis, resulting in higher flowability of the toner.

The values of r1, r2, and r3 are measured, by taking a number of photographs from various angles by SEM and analyzing the photographs.

The thus produced toner can be used not only as a single-component magnetic toner without using magnetic carrier, but also as a non-magnetic toner.

When the above-noted toner is applied to a two-component developer, the toner may be used as a mixture with a magnetic carrier. Examples of the magnetic carrier include a ferrite containing a divalent metal, such as iron, magnetite, manganese, zinc and copper and the magnetic carrier has a volume average particle diameter of preferably 20 μm to 100 μm. When the volume average particle diameter is less than 20 μm, the carrier tends to adhere onto the photoconductor during the developing step. On the other hand, when the volume average particle diameter is more than 100 μm, the mixing properties of the carrier with the toner becomes low and the charged amount of the toner is unsatisfactory, so that the charging failure of the toner is easily caused during the continuous use of the toner. Further, as a magnetic carrier, Cu ferrite containing Zn is preferred from the viewpoint of having a high saturation magnetization; however, the magnetic carrier may be properly selected depending on the process of the image forming apparatus. The resin for coating the magnetic carrier is not restricted. Examples of the resin for coating the magnetic carrier with the resin include a silicone resin, a styrene-acrylic resin, a resin containing a fluorine an and an olefin resin. Examples of the method for coating the magnetic carrier the resin include a method in which a coating resin is dissolved in a solvent and the magnetic carrier core is coated by spraying a coating liquid while the core flows, and a method in which particles of the coating resin are attached electrostatically to particles of the magnetic carrier core and followed by fusing thermally particles of the coating resin to coat particles of the magnetic carrier core. The coating film has a thickness of generally 0.05 μm to 10 μm, preferably 0.3 μm to 4 μm.

The image forming apparatus according to the present invention comprises a photoconductor, a charging unit configured to charge the photoconductor, an exposing unit configured to expose the photoconductor for forming a latent electrostatic image, a developing unit configured to develop the latent electrostatic image using a toner for forming a toner image, which is supplied with the toner, a transferring unit configured to transfer the toner image carried on the photoconductor to a recording medium and a fixing unit configured to fix the toner image on the recording medium, wherein the toner is the toner according to the present invention.

The image forming process according to the present invention is performed using the above-noted image forming apparatus according to the present invention, which comprises charging the photoconductor, exposing the photoconductor for forming a latent electrostatic image, developing the latent electrostatic image using the toner for forming the toner image, transferring the toner image carried on the photoconductor to a recording medium, and fixing the toner image on the recording medium, wherein the toner is the toner according to the present invention.

With respect to the above-noted image forming apparatus according to the present invention, particularly, an image forming apparatus in which the image is fixed using a toner which can be fixed at a lower temperature by fixing the toner image through passing the toner image carried on the recording medium through between two rollers, wherein a surface pressure (load of the roller/contacting area) applied to between the two rollers is $1.5\times10^5$ Pa or less during fixing an image, is also preferred.

Figure 4:
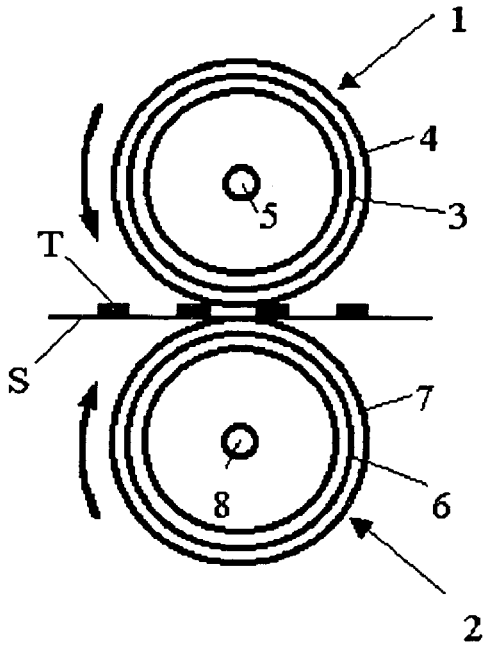
FIG. 4 is a view schematically showing an example of the fixing unit in the image forming apparatus according to the present invention.

FIG. 4 is a schematic view showing an example of a fixing unit in the image forming apparatus according to the present invention. In the FIG. 4, (1) represents a fixing roller, (2) represents a pressing roller, (3) represents a metal cylinder, (4) represents an anti-offset layer, (5) represents a heating lamp, (6) represents a metal cylinder, (7) represents an anti-offset layer, (8) represents a heating lamp, (T) represents the toner image and (S) represents a carrier (e.g., transferring paper).

In the related art, there is not such a fixing unit in which the image-fixing is performed by applying a surface pressure (load of the roller/contacting area) of $1.5\times10^5$ Pa or less, with respect to a similar fixing unit to the fixing unit in the image forming apparatus according to the present invention. In a conventional fixing unit, the surface pressure is more than $1.5\times10^5$ Pa and otherwise, the fixing could not be performed satisfactorily. On the other hand, by using the toner according to the present invention, the fixing can be performed at a low temperature and also at a low surface pressure, such as a surface pressure of $1.5\times10^5$ Pa or less. Further, by reducing the surface pressure to a low pressure, the toner image carried on the recording medium is not pushed onto the recording medium, thus a highly fine image can be output.

The image forming apparatus according to the present invention is an image forming apparatus in which the fixing unit comprises a heater equipped with a heating element, a film contacted with the heater and a pressing member contacted with the heater through the film, and a recording medium carrying an unfixed image is inserted between the film and the pressing member so as to heat and fix the toner image.

Figure 5:
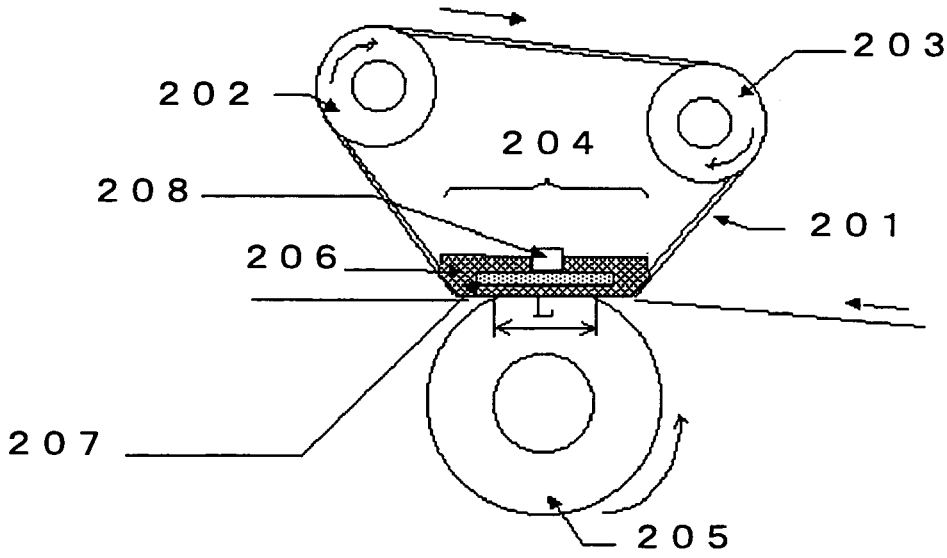
FIG. 5 is a view schematically showing an example of the fixing unit according to the present invention.

The fixing unit according to the present invention is, as shown in FIG. 5, a so-called a surf fixing unit in which the fixing is performed by rotating the fixing film 201. Hereinbelow, with respect to the fixing unit according to the present invention, explanations are given in detail. The fixing film 201 is a heat resistant film in the form of an endless belt which is stretched among the driving roller 202 supporting and rotating the fixing film 201, the roller 203 which is rotated according to the driving roller 202 and the heater 204 which is arranged under the two rollers and is fixed to and supported by a heater supporter.

The roller 203 has also the function as a tension roller of the fixing film 201 and the fixing film 201 is rotationally driven in the clockwise direction by rotationally driving the driving roller 202 in the clockwise direction. The rate of rotary driving of the driving roller 202 is controlled to a rotation rate by which the rotation rate of the recording medium becomes the same as that of the fixing film 201 in the fixing nip region L in which the pressing roller 205 is contacted with the fixing film 201.

Here, the pressing roller 205 is a roller comprising a rubber elasticity layer having advantageous releasing properties, such as a silicone rubber and is contacted with the above-noted fixing nip region L with a pressure of 4 kg to 10 kg while the pressing roller 205 is rotated in the anti-clockwise direction.

The fixing film 201 is preferably excellent in heat resistance, releasing properties and durability and has a thickness of 100 μm or less, preferably 40 μm or less. Examples of the fixing film 201 include a single layer film made of a heat resistant resin, such as a polyimide resin, a polyetherimide resin, a PES (polyethersulfide) resin, a PFA (teterafluoroethylene-perfluoroalkylvinylether copolymer resin) and a laminated film produced, for example, by disposing either a releasable coating layer having a thickness of 10 μm comprising a fluorine-containing resin, such as a PTFE (tetrafluoroethylene resin) and a PFA and a conductive material or an elasticity layer of a fluorine rubber or a silicone rubber at least on a surface of the film having a thickness of 20 μm, in which the surface is contacted with the image which.

In FIG. 5, the heater 204 according to the present invention comprises the plate substrate 206 made of a material having a high thermal conductivity and a high electric resistivity, such as an alumina, and the fixing heater 207. And on the surface of the plate substrate 206 which is contacted with the fixing film 201, the fixing heater 207 comprising an exothermic resistor is arranged in the longitudinal direction. The thus fixing heater 207 is produced by coating the plate substrate 206 with an electrically resistant material, such as Ag/Pd and $Ta_2N$ in the form of a line or a strip according to a screen printing method. At the both terminals of the fixing heater 207, electrodes (not shown in FIG. 5) are formed and by applying the electricity to between the two electrodes, a resistance heating element generates the heat. Further, on a surface of the plate substrate 206 which is opposite to the surface on which the fixing heater 207 is arranged, the sensor of fixing temperature 208 is arranged.

The temperature information of the plate substrate 206 which is detected by the sensor of fixing temperature 208 is sent to a controlling unit (not shown in FIG. 5) and by the controlling unit, the amount of the electric power supplied to the fixing heater 207 is controlled, so that the temperature of the heater 204 is adjusted to a specified temperature.

The process cartridge according to the present invention is a process cartridge using the toner according to the present invention and comprising a photoconductor and at least one unit selected from the group consisting of a charging unit, a developing unit and a cleaning unit, wherein the photoconductor and at least one unit are integrated as one unit and the process cartridge is attached to the main body of the image forming apparatus in an attachable and detachable manner.

Figure 6:
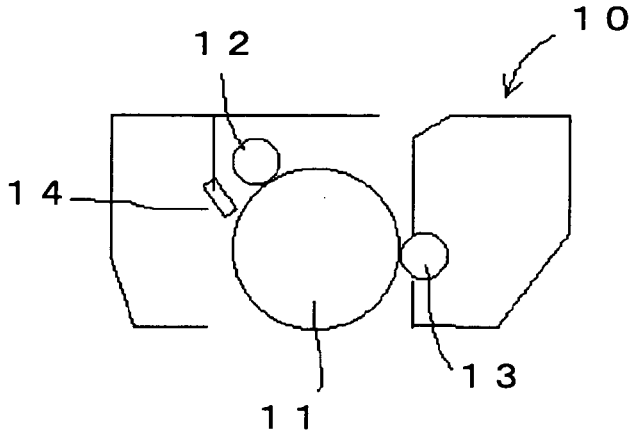
FIG. 6 is a view schematically showing an example of the composition of the image forming apparatus equipped with the process cartridge according to the present invention.

FIG. 6 is a schematic view showing an example of the image forming apparatus comprising the process cartridge according to the present invention.

In FIG. 6, 10 represents the whole process cartridge, 11 represents the photoconductor, 12 represents a charging unit, 13 represents a developing unit and 14 represents a cleaning unit.

According to the present invention, plural units among the above-noted photoconductor 11, charging unit 12, developing unit 13 and cleaning unit 14 are integrated as the process cartridge and the process cartridge is attached to the main body of the image forming apparatus of a copying machine or a printer in an attachable or detachable manner.

In the image forming apparatus which equips the process cartridge of the present invention, the photoconductor is driven to be rotated at a predetermined peripheral velocity. During the cycle of a rotation of the photoconductor, the charging unit uniformly charges the photoconductor at a predetermined positive or negative potential, thereafter a light irradiator, such as slit exposure or laser beam scanning exposure, irradiates light image wisely to the charged photoconductor. In this way, latent electrostatic images are sequentially formed on the circumference surface of the photoconductor. As follows, the developing unit develops the formed latent electrostatic image with the toner so as to form a toner image, and then the transfer unit sequentially transfers the toner image onto a recording medium (including an intermediate transfer medium) which is fed from a paper feeder to between the photoconductor and the transfer unit at the same timing to the rotation of the photoconductor. The recording medium bearing the transferred toner image is separated from the photoconductor, and is introduced to the image-fixing unit. The image-fixing unit fixes the transferred image onto the recording medium so as to form a reproduction (copy) and then the copy is sent out from the apparatus, i.e., printed out. After transferring the toner image, cleaning unit removes the remained toner onto the surface of the photoconductor so as to clean the surface. Thereafter, the photoconductor is destaticized so as to be ready for the following image formation.

In the image forming apparatus according to the present invention, the photoconductor used for forming the image is an amorphous silicone photoconductor.

(Amorphous Silicon Photoconductor)

In the present invention, an amorphous silicon photoconductor (hereinafter referring to as "a-Si photoconductor") may be employed which is produced by way of heating a conductive support to 50° C. to 400° C. and depositing on the conductive substrate a photoconductive layer of amorphous silicon through vacuum deposition, spattering, ion-plating, thermal CVD, optical CVD, plasma CVD, or the like. Among these, preferable method is plasma CVD in which raw material gas is decomposed by glow discharge of direct current, high frequency, or microwave, and then a-Si is deposited on the substrate to form an a-Si film.

(Layer Structure)

Figure 7A:
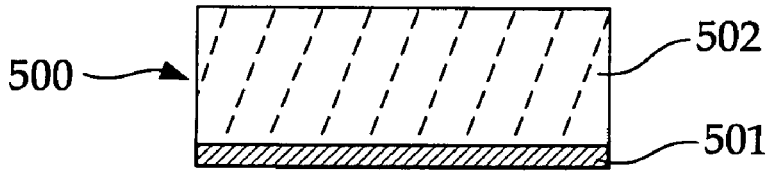
FIGS. 7A, 7B, 7C and 7D are sectional views schematically showing examples of the layers structure of the photoconductor according to the present invention.
Figure 7B:
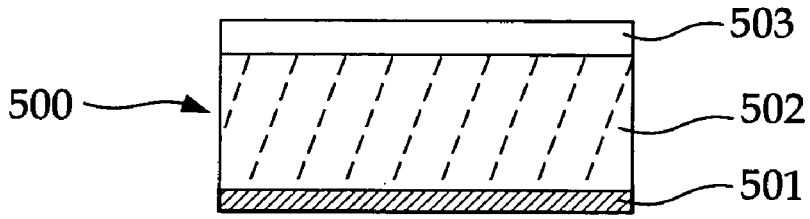
Figure 7C:
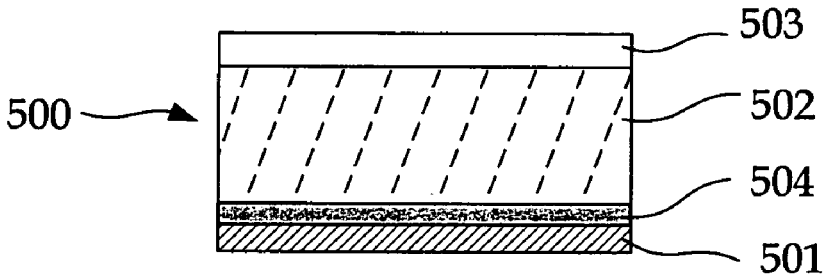
Figure 7D:
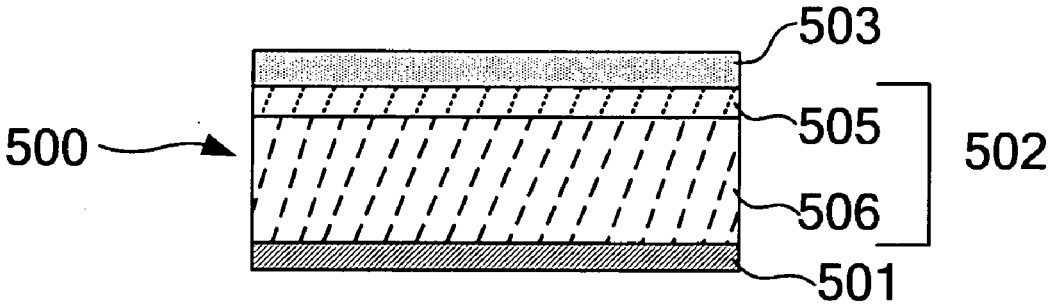

The amorphous silicon photoconductor has a layer structure as follows. FIGS. 7A to 7D are schematic diagrams which explain the layer structure of the amorphous silicon photoconductor. In FIG. 7A, an electrophotographic photoconductor 500 has a substrate 501 and a photoconductive layer 502 on the substrate 501. The photoconductive layer 502 is formed of a-Si: H, X, and exhibits photoconductivity. In FIG. 7B, an electrophotographic photoconductor 500 has a substrate 501, and a photoconductive layer 502 formed of a-Si: H, X and an amorphous silicon surface layer 503. In FIG. 7C, an electrophotographic photoconductor 500 has a substrate 501, and a photoconductive layer 502 formed of a-Si: H, X, an amorphous silicon surface layer 503 and an amorphous silicon charge injection inhibiting layer 504. In FIG. 7D, an electrophotographic photoconductor 500 has a substrate 501 and a photoconductive layer 502 on the substrate 501. The photoconductive layer 502 consists of a charge generating layer 505 formed of a-Si: H, X and a charge transport layer 506. The electrophotographic photoconductor 500 further has an amorphous silicon surface layer 503 on the photoconductive layer 502.

(Substrate)

The substrate of the photoconductor may be conductivity or isolating. Examples of the conductive substrate include metals such as Al, Cr, Mo, Au, In, Nb, Te, V, Ti, Pt, Pd, Fe and the like, and alloys thereof such as stainless alloy and the like. Also, it can be use as a substrate that an insolating substrate such as a film or sheet of synthetic resin such as polyester, polyethylene, polycarbonate, cellulose acetate, polypropylene, polyvinyl chloride, polystyrene, polyamide, or the like, glass, ceramic, in which at least a surface where faces to a photoconductive layer is treated to yield conductivity.

The shape of the substrate may be cylindrical, plate, or endless belt, which has a smooth or irregular surface. The thickness of thereof can be adjusted so as to form a predetermined photoconductor. In the case that flexibility is required to the photoconductor, the substrate can be as thinner as possible, provided that efficiently functioning as a substrate. The thickness of the substrate is generally 10 μm or more from the viewpoints of manufacture, handling, mechanical strength, and the like.

(Charge Injection Inhibiting Layer)

In the photoconductor used in the present invention, it is effective to dispose a charge injection inhibiting layer, which inhibits a charge injection from a conductive substrate, between the conductive substrate and the photoconductive layer (refer to FIG. 7C). The charge injection inhibiting layer has a polarity dependency. Namely, when charging of single polarity is applied to a free surface of the photoconductor, the charge injection inhibiting layer functions so as to inhibit a charge injection from the conductive substrate to the photoconductive layer, and when charging of opposite polarity is applied, the charge injection inhibiting layer does not function. In order to attain such function, the charge injection inhibiting layer has relatively a lot of atoms which control conductivity, compared with the photoconductive layer.

Provided that obtaining a predetermined electrophotographic property and cost efficiency, the thickness of the charge injection layer is preferably 0.1 μm to 5 μm, more preferably 0.3 μm to 4 μm, and most preferably 0.5 μm to 3 μm.

(Photoconductive Layer)

The photoconductive layer is disposed above an undercoat layer, if needed. The thickness of the photoconductive layer is not particularly limited, provided that obtaining a predetermined electrophotographic property and cost efficiency. The thickness thereof is preferably about 1 μm to 100 μm, more preferably 20 μm to 50 μm, and most preferably 23 μm to 45 μm.

(Charge Transport Layer)

The charge transport layer is, in the case that the photoconductive layer is divided by its functions, a layer which mainly functions to transport charges. The charge transport layer contains at least a silicon atom, a carbon atom, and a fluoride atom as its essential component. If needed, the charge transport layer further contains a hydrogen atom and an oxygen atom so that the charge transport layer is formed of a-SiC(H,F,O). Such charge transport layer exhibits desirable photoconductivity, especially charge holding property, charge generating property, and charge transporting property. It is particularly preferable that the charge transport layer contains an oxygen atom.

The thickness of the charge transport layer is suitably adjusted so as to obtain desirable electrophotographic property and cost efficiency. The thickness thereof is preferably about 5 μm to about 50 μm, more preferably 10 μm to 40 μm, and the most preferably 20 μm to 30 μm.

(Charge Generating Layer)

The charge generating layer is, in the case that the photoconductive layer is divided by its functions, a layer which mainly functions to generate charges. The charge generating layer contains at least a silicon atom as an essential component and does not substantially contain a carbon atom. If needed, the charge generating layer further contains a hydrogen atom so that the charge generating layer is formed of a-Si:H. Such charge generating layer exhibits desirable photoconductivity, especially charge generating property and charge transporting property.

The thickness of the charge generating layer is suitably adjusted so as to obtain desirable electrophotographic property and cost efficiency. The thickness thereof is preferably about 0.5 μm to about 15 μm, more preferably 1 μm to 10 μm, and the most preferably 1 μm to 5 μm.

(Surface Layer)

The amorphous silicon photoconductor used in the present invention may further contain a surface layer disposed on the photoconductive layer which is formed on the substrate as mentioned above. It is preferred to contain an amorphous silicon surface layer. The surface layer has a free surface so that desirable properties such as moisture resistance, repeating property, electric pressure tightness, environmental capability, durability and the like.

The thickness of the surface layer is generally 0.01 μm to 3 μm, preferably 0.05 μm to 2 μm, and more preferably 0.1 μm to 1 μm. When the thickness thereof is less than about 0.01 μm, the surface layer is worn out during usage of the photoconductor. When the thickness thereof is more than 3 μm, electrophotography property is impaired such as an increase of residual charge, and the like.

The image-forming apparatus of the present invention is characterized in that an alternating electric field is applied when a latent electrostatic image on the photoconductor is developed.

Figure 8:
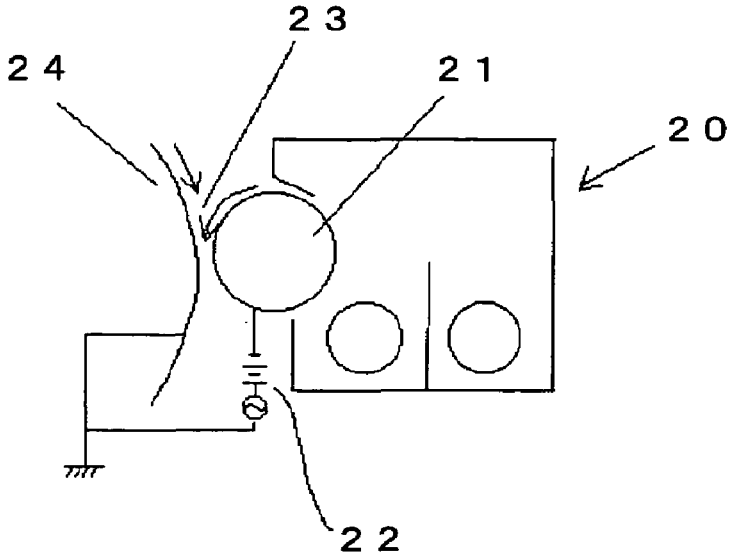
FIG. 8 is a view schematically showing an example of the developing unit according to the present invention.

In an image developer 20 shown in FIG. 8, a power source 22 applies vibration bias voltage as developing bias, in which voltage direct current and alternating voltage are superpositioned, to a developing sleeve 21 during developing. The potential of background part and the potential of image part are positioned between maximum value and minimum value of the vibration bias potential. This forms an alternating electric field in which directions alternately change at developing region 23. A toner and a carrier are intensively vibrated in this alternating electric field, so that the toner overshoots the electrostatic force of constraint from the developing sleeve 21 and the carrier, and leaps to the photoconductor 24. The toner is then attached to the photoconductor relative to a latent electrostatic image thereon.

The difference of maximum value and minimum value of the vibration bias voltage (peak range voltage) is preferably 0.5 KV to 5 KV, and the frequency is preferably 1 KHz to 10 KHz. The waveform of the vibration bias voltage may be a rectangle wave, a sine wave, or a triangle wave. The voltage direct current of the vibration bias voltage is in the range of the potential at the background and the potential at the image as mentioned above, and is preferable set closer to the potential at the background from viewpoints of inhibiting a toner deposition on the background.

In the case that the waveform of the vibration bias voltage is a rectangle wave, it is preferred that a duty ratio is 50% or less. Here, the duty ratio is a ratio of time when the toner leaps to the photoconductor during a cycle of the vibration bias. In this way, the difference between the peak time value when the toner leaps the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier, which has an opposite polarity of charge to the toner, leaps to the photoconductor and the time average value of bias can be small. Consequently the movement of the carrier can be restrained and the possibility of the carrier deposition on the background is largely reduced.

The image-forming apparatus of the present invention is characterized in the charger disposed therein, wherein the charger contains a charging member, and the charging member is contacted to a latent image bearing member and applied voltage so as to charge the photoconductor.

(Roller Charger)

Figure 10A:
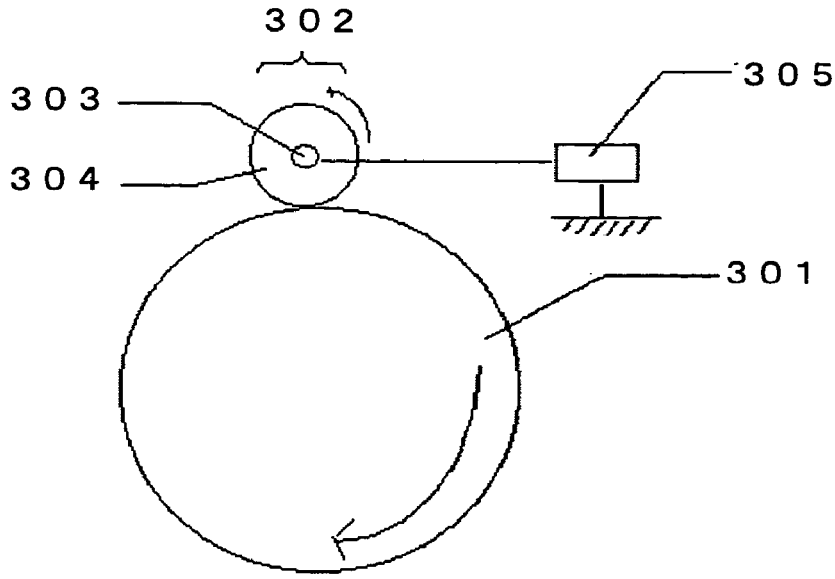
FIG. 10A is a view schematically showing an example of the charger configured to charge the photoconductor by contacting a roller with the photoconductor and FIG. 10B is a view schematically showing an example of the charger configured to charge the photoconductor by contacting a brush with the photoconductor.

FIG. 10A is a schematic diagram of an example of the image-forming apparatus that equips a contact charger. The photoconductor 301 as an object to be charged and image bearing member, is rotated at a predetermined speed (process speed) in the direction shown with the arrow in the figure. The charging roller 302, which is a charging member and subjected to be in contact with the photoconductor 301, contains a core rod 303 and a conductive rubber layer 304 formed on the core rod in a shape of a concentric circle. The both terminals of the core rod are supported with pillow blocks (not shown in FIG. 10A) so that the charging roller enables to rotate freely, and the charging roller 302 is pressed to the photoconductor 301 at predetermined pressure by a pressurizing member (not shown in FIG. 10A). The charging roller 302 in this figure therefore rotates along with the rotation of the photoconductor 301. The charging roller 302 is generally formed with a diameter of 16 mm in which a core rod 303 having a diameter of 9 mm is coated with a rubber layer having a moderate resistance of approximately 100,000 Ω·cm.

Figure 9:
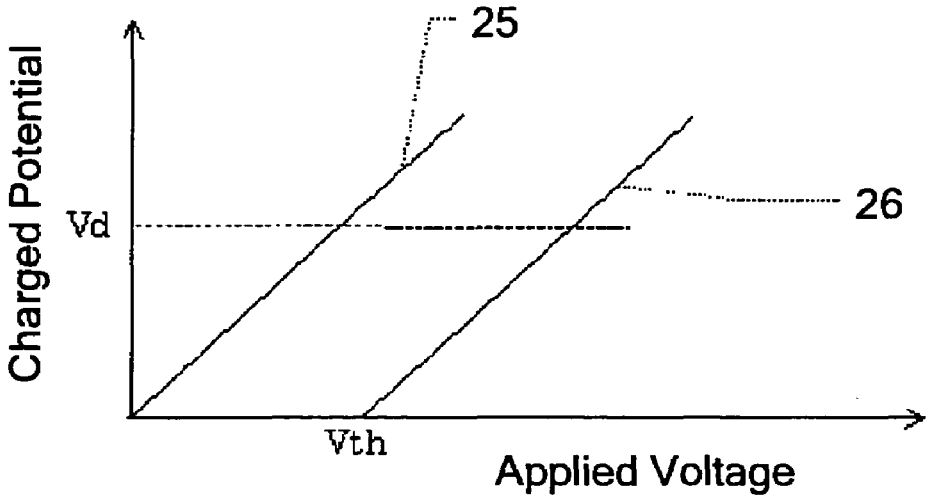
FIG. 9 is a view schematically showing an example of charging properties of the contact charge.

The power source 305 shown in the figure is electrically connected with the core rod 303 contained in the charging roller 302, and a predetermined bias is applied to the charging roller 302 by the power source 305. In this way, the surface of the photoconductor is uniformly charged at a predetermined polarity and potential. FIG. 9 is a view showing an example of the charging property of contact charge.

As a charger used in the present invention, an embodiment thereof is not particularly limited and the shaped of the charging member can be, apart from a roller, a magnetic brush, a fur brush or the like. It can be suitably selected according to a specification or embodiment of an image-forming apparatus. In the case that a magnetic brush is used as a charger, the magnetic brush contains a charging member formed of various ferrite particles such as Zn—Cu ferrite, a non-magnetic conductive sleeve to support the charging member, and a magnetic roller contained in the non-magnetic conductive sleeve. In the case that a fur brush is used as a charger, a material of the fur brush is, for example, a fur that is conductively treated with carbon, cupper sulfide, metals or metal oxides, and the fur is coiled or mounted to a core rod which is formed of a metal or is conductively treated.

(Fur Brush Charger)

Figure 10B:
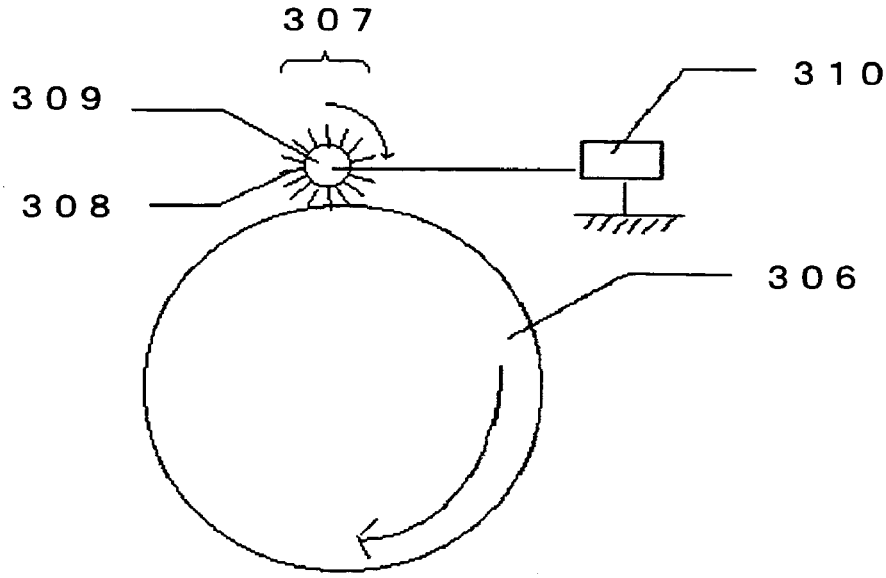

FIG. 10B is a schematic diagram of an example of the image-forming apparatus that equips a contact charger. The photoconductor 306 as an object to be charged and image bearing member, is rotated at a predetermined speed (process speed) in the direction shown with the arrow in the figure. The brush roller 307 having a fur brush is subjected to be in contact with the photoconductor 306, with a predetermined nip width and a predetermined pressure with respect to elasticity of the brush part.

The fur brush roller 307 as the contact charging member used in the present invention, has an outside diameter of 14 mm, and a stretcher length of 250 mm. In this fur brush, a tape with a pile of conductive rayon fiber REC-B (manufactured by Unitika Ltd.), as a brush part 308, is spirally coiled around a core rod 309 having a diameter of 6 mm, which is also functioned as an electrode. The brush of the brush part 308 is 300 denier/50 filament, and a density of 155 fibers per 1 square millimeter. This role brush is once inserted into a pipe having an internal diameter of 12 mm with rotating in a certain direction, and is set so as to be a concentric circle relative to the pipe. Thereafter, this role brush in the pipe is left in an atmosphere of high humidity and high temperature so as to twist and tilt the fibers of the fur.

The resistance of the fur brush roller is $1\times10^5$ Ω relative to the applied voltage of 100 V. This resistance is calculated from the charge obtained when the fur brush rolled is contacted with a metal drum having a diameter of 30 mm with a nip width of 3 mm then a voltage of 100 V is applied thereon.

The resistance of the fur brush roller needs to be $10^4$ Ω or more in order to prevent image imperfection caused by an insufficient charge at the charging nip part when the photoconductor as an object to be charged happens to have low pressure-resistance defects such as pin holes thereon and an excessive leak current therefore runs into the defects. Moreover, the resistance of the fur brush roller needs to be $10^7$ Ω or less in order to sufficiently charge the surface of the photoconductor.

The material of the fur may suitably be other than REC-B (manufactured by Unitika Ltd.). Examples of the material include REC-C, REC-M1, REC-M10 (manufactured by Unitika Ltd.), SA-7 (manufactured by Toray Industries, Inc.), Thunderon (manufactured by Nihon Sanmo Dyeing Co., Ltd.), Beltron (manufactured by Kanebo Gohsen, Ltd.), Kuracarbo in which carbon is dispersed in rayon (manufacture by Kuraray Co., Ltd.), Robal (manufactured by Mitsubishi Rayon Co., Ltd.), and the like. The brush is, preferably 3 denier per fiber to 10 denier per fiber, 10 filaments per bundle to 100 filaments per bundle, and 80 fibers per square millimeter to 600 fibers per square millimeter. The length of the fur is preferably 1 mm to 10 mm.

The fur brush roller is rotated in the opposite (counter) direction to the rotation direction of the photoconductor at a predetermined peripheral velocity, and contacts with the photoconductor, with velocity deference. The power source 310 applies a predetermined charging voltage to the fur brush roller 307 so that the surface of the photoconductor 306 is uniformly charged at a predetermined polarity and potential. In contact charge of the photoconductor 306 by the fur brush roller 307 of the present embodiment, direct injection charge is dominantly performed and the surface of the photoconductor is charged at the substantially equal voltage to the applying charging voltage to the fur brush roller.

As a charger used in the present invention, an embodiment thereof is not particularly limited and the shape of the charging member can be, apart from a fur brush roller, a charging roller, a fur brush or the like. It can be suitably selected according to a specification or embodiment of an image-forming apparatus. When the charging roller is used, the charging roller is produced generally by disposing a rubber layer having a middle electric resistance, such as 100,000 Ω·cm on the core rod. In the case that a magnetic brush is used as a charger, the magnetic brush contains a charging member formed of various ferrite particles such as Zn—Cu ferrite, a non-magnetic conductive sleeve to support the charging member, and a magnetic roller contained in the non-magnetic conductive sleeve.

(Magnetic Brush Charger)

FIG. 10B is a schematic diagram of an example of the image-forming apparatus which quips a contact charger. The photoconductor as an object to be charged and image bearing member, is rotated at a predetermined speed (process speed) in the direction shown with the arrow in the figure. The brush roller having a magnetic brush is subjected to be in contact with the photoconductor, with a predetermined nip width and a predetermined pressure with respect to elasticity of the brush part.

The magnetic brush as a contact charging member of the present embodiment is formed of magnetic particles. In the magnetic particles, Z-Cu ferrite particles having an average particle diameter of 25 μm and Z-Cu ferrite particles having an average particle diameter of 10 μm are mixed in a mass ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charging member of this embodiment formed from the above-mentioned coated magnetic particles, a non-magnetic conductive sleeve which supports the coated magnetic particles, and a magnet roller which is included in the non-magnetic conductive sleeve. The coated magnetic particles are disposed on the sleeve with the thickness of 1 mm so as to form a charging nip of 5 mm with the photoconductor. Moreover, the width between the non-magnetic conductive sleeve and the photoconductor is adjusted to approximately 500 μm. Further, the magnetic roller is rotated so as to subject the non-magnetic conductive sleeve to rotate at twice in speed relative to the peripheral speed of the surface of the photoconductor, and in the opposite direction with the photoconductor. Therefore, the magnetic brush is set to uniformly contact with the photoconductor.

As a charger used in the present invention, an embodiment thereof is not particularly limited and the shape of the charging member can be, apart from a magnetic brush, a charging roller, a fur brush or the like. It can be suitably selected according to a specification or embodiment of an image-forming apparatus. When the charging roller is used, the charging roller is produced generally by disposing a rubber layer having a middle electric resistance, such as 100,000 Ω·cm on the core rod. In the case that a fur brush is used as a charger, a material of the fur brush is, for example, a fur that is conductively treated with carbon, cupper sulfide, metals or metal oxides, and the fur is coiled or mounted to a core rod which is formed of a metal or is conductively treated.

EXAMPLES

Hereinafter, with respect to the present invention, further explanations are given referring to Examples, which should not be construed as limiting the scope of the present invention. In Examples, "parts" means "parts by mass".

As a magnetic carrier applied to a two-component developer, in each of Examples of the present invention, the following magnetic carrier was commonly used.

(Preparing of Magnetic Carrier)

| Core material | |
|---|---|
| Cu—Zn ferrite particles (having a mass average particle diameter of 35 μm) | 5,000 parts |
| Coating Material (composition) | |
| Toluene | 450 parts |
| Silicone resin (trade name: SR 2400, manufactured by Dow Corning Toray Silicone Co., Ltd. having a content of a non-volatile component of 50 %) | 450 parts |
| Aminosilane resin (trade name: SH 6020, manufactured by Dow Corning Toray Silicone Co., Ltd.) | 10 parts |
| Carbon black | 10 parts |

The coating materials were dispersed by a stirrer for 10 minutes to prepare a coating liquid. The coating liquid and the core material were poured into a coating apparatus which was equipped with a rotary bottom-plate disc and a swirl-stream stirring blade within a fluidizing bed. The coating liquid was coated on the core material and was calcined at 250° C. for 2 hours to prepare the carrier, which is coated with the silicone resin of an average thickness of 0.5 μm.

(Preparing of Two-Components Developer)

A developer was prepared by uniformly mixing 100 parts of carrier and each 7 parts of respective toners in the following examples by means of Turbula mixer that can mix components through tumbling.

Example 1

(Preparation of Organic Fine-Particle Emulsion)

Into a reactor equipped with a stirring rod and a thermometer were poured 683 parts of water, 11 parts of sodium salt of sulfuric acid ester of ethylene oxide adduct of methacrylic acid (trade name: Eleminol RS-30, manufactured by Sanyo Chemical Industries, Ltd.), 83 parts of styrene, 83 parts of methacrylic acid, 110 parts of butyl acrylate, and 1 part of ammonium persulfate; and the mixture was stirred at 3,800 rpm for 30 minutes to yield a white emulsion. The emulsion was heated to 75° C. and was allowed to react for 4 hours. The reaction mixture was further treated with 30 parts of a 1% aqueous solution of ammonium persulfate, was aged at 75° C. for 6 hours, thereby yielded an aqueous dispersion of vinyl resin i.e. a copolymer of styrene-methacrylic acid-butyl acrylate-sodium salt of sulfate ester of methacrylic acid-ethylene oxide adduct (hereinafter referring to as [Fine particles dispersion 1]). [Fine Particle Dispersion 1] had a volume-average particle diameter of 110 nm by the laser diffraction/particle size distribution analyzer LA-920 (manufactured by Horiba, Ltd.). A part of [Fine Particle Dispersion 1] was dried to isolate the resin component. The resin component had a Tg of 58° C. and a mass-average molecular mass of about 130,000.

(Preparing of Aqueous Phase)

An opaque liquid was prepared by blending and stirring 990 parts of water, 83 parts of [Fine Particle Dispersion 1], 37 parts of 48.3% aqueous solution of sodium dodecyldiphenylether disulfonate (Eleminol MON-7, manufactured by Sanyo Chemical Industries, Ltd.), and 90 parts of ethylacetate (hereinafter referring to as [Aqueous Phase 1]).

(Synthesis of Lower Molecular-Mass Polyester)

Into a reactor equipped with a condenser, a stirrer, and a nitrogen gas feed tube were poured 724 parts of ethylene oxide (2 mole) adduct of bisphenol A and 276 parts of terephthalic acid. The mixture was subjected to polycondensation reaction at 230° C. at normal atmospheric pressure for 7 hours and was further reacted at a reduced pressure of 10 mmHg to 15 mmHg for 5 hours, thereby yielded a reaction product (hereinafter referring to as [Lower Molecular-Mass Polyester 1]). The [Lower Molecular-Mass Polyester 1] had a number-average molecular mass of 2,300, a mass-average molecular mass of 6,700, a peak molecular mass of 3,800, a Tg of 43° C., and an acid value of 4.

(Synthesis of Intermediate Polyester)

Into a reactor equipped with a condenser, a stirrer, and a nitrogen gas feed tube were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at normal atmospheric pressure for 7 hours, was further reacted under a reduced pressure of 10 mmHg to 15 mmHg for 5 hours, thereby yielded a reaction product having a number-average molecular mass of 2,200, a mass-average molecular mass of 9,700, a peak molecular mass of 3,000, a Tg of 54° C., an acid value of 0.5, and a hydroxyl value of 52 (hereinafter referring to as [Intermediate Polyester 1]).

Then, into a reactor equipped with a condenser, a stirrer, and a nitrogen gas feed tube were poured 410 parts of [Intermediate Polyester 1], 89 parts of isophorone diisocyanate, and 500 parts of ethylacetate, followed by reaction at 100° C. for 5 hours to yield a reaction product having a free isocyanate content of 1.53% by mass (hereinafter referring to as [Prepolymer 1]).

(Synthesis of Ketimine)

Into a reactor equipped with a stirring rod and a thermometer were poured 170 parts of isophoronediamine and 75 parts of methyl ethyl ketone, followed by reaction at 50° C. for 4.5 hours to yield a reaction product having an amine value of 417 (hereinafter referring to as [Ketimine Compound 1]).

(Synthesis of Master Batch)

A total of 12,00 parts of water, 540 parts of a carbon black (trade name: Printex 35, manufactured by Degussa AG) having a DPB oil absorption of 42 ml/100 mg and pH of 9.5, and 1,200 parts of a polyester resin were mixed in HENSCHEL MIXER (manufactured by Mitsui Mining Co.). The mixture was kneaded at 130° C. for 1 hour by a double roll mill, cold-rolled, and milled by a pulverizer, thereby yielded [Master Batch 1].

(Preparing of Oil Phase)

Into a reactor equipped with a stirring rod and a thermometer were poured 378 parts of [Lower Molecular-Mass Polyester 1], 100 parts of carnauba wax, and 947 parts of ethylacetate. The mixture was heated at 80° C. for 5 hours with stirring and was then cooled to 30° C. over 1 hour. The mixture was further treated with 500 parts of [Master Batch 1] and 500 parts of ethylacetate with stirring for 1 hour, thereby yielded [Material Solution 1].

Thereafter, 1324 parts of [Material Solution 1] was poured into a vessel, and the components therein were dispersed using a bead mill (trade name: Ultravisco-Mill, manufactured by Aimex Co.) at a liquid feeding speed of 1 kg/hr, a disc rotation speed of 6 m/sec, using zirconia beads 0.5 mm in diameter filled 80% by volume. The dispersing procedure was repeated three times. The dispersion was further treated with 1324 parts of 65% ethylacetate solution of [Lower Molecular-Mass Polyester 1], and the mixture was dispersed under the above conditions except that the dispersion procedure was repeated two times to yield [Pigment-Wax Dispersion 1]. [Pigment-Wax Dispersion 1] had a solid content of 50%.

(Emulsifying and Removing the Solvent)

Into a vessel were poured 749 parts of [Pigment-Wax Dispersion 1], 115 parts of [Prepolymer 1], and 2.9 parts of [Ketimine Compound 1]; and the mixture was mixed at 5,000 rpm for 2 minutes using TK Homo Mixer (manufactured by Tokushu Kika Kogyo Co.), then 1,200 parts of [Aqueous Phase 1] were added, and the mixture was further mixed at 13,000 rpm for 25 minutes using the TK Homo Mixer, thereby yielded [Emulsified Slurry 1].

Into a vessel equipped with a stirrer and a thermometer was poured [Emulsified Slurry 1] and was heated at 30° C. for 7 hours to remove the solvents, and the slurry was aged at 45° C. for 7 hours, thereby yielded [Dispersed Slurry 1].

(Washing and Drying)

A total of 100 parts of [Dispersed Slurry 1] was filtered under a reduced pressure and was washed by the following procedures.

I: The filtered cake and 100 parts of deionized water were mixed in TK Homo Mixer at 12,000 rpm for 10 minutes, and the mixture was filtered.

II: The filtered cake prepared in I and 100 parts of 10% aqueous solution of sodium hydroxide were mixed in TK Homo Mixer at 12,000 rpm for 10 minutes, and the mixture was filtered under a reduced pressure.

III: The filtered cake prepared in II and 100 parts of 10% hydrochloric acid were mixed in TK Homo Mixer at 12,000 rpm for 10 minutes, and the mixture was filtered.

IV: The filtered cake prepared in III and 300 parts of deionized water were mixed in TK Homo Mixer at 12,000 rpm for 10 minutes, and the mixture was filtered, wherein this washing procedure was repeated twice to yield [Filtered Cake 1].

The [Filtered Cake 1] was dried at 45° C. for 48 hours in a circulating air dryer. Then, the mixture was screened through a mesh of 75 μm opening, thereby [Toner Base Particles 1] was obtained. Then, 100 parts of the [Toner Base Particles 1], 1 part of hydrophobic silica and 1 part of hydrophobic-treated titanium oxide were mixed using HENSCHEL MIXER thereby to produce a [Toner 1]. The resultant toner was shown in Table 1 as to the physical properties and in Table 2 as to the evaluations.

Example 2

A toner was produced and evaluated in the same manner as Example 1, except that the method for preparing the oil phase was changed as follows. The resultant [Toner 2] was shown in Table 1 as to the physical properties and in Table 2 as to the evaluations.

(Preparing of Oil Phase)

Into a reactor equipped with a stirring rod and a thermometer were poured 378 parts of [Lower Molecular-Mass Polyester 1], 100 parts of carnauba wax, and rice wax (in a mixing mass ratio of 7:3) and 947 parts of ethylacetate. The mixture was heated at 80° C. for 4 hours with stirring and was then cooled to 30° C. over 1 hour. The mixture was further treated with 500 parts of [Master Batch 1] and 500 parts of ethylacetate with stirring for 1 hour, thereby yielded [Material Solution 2].

Thereafter, 1324 parts of [Material Solution 2] was poured into a vessel, and the components therein were dispersed using a bead mill (Ultravisco-Mill, by Aimex Co.) at a liquid feeding speed of 1 kg/hr, a disc rotation speed of 6 m/sec, using zirconia beads 0.5 mm in diameter filled 80% by volume. The dispersing procedure was repeated seven times. The dispersion was further treated with 1324 parts of 65% ethylacetate solution of [Lower Molecular-Mass Polyester 1], and the mixture was dispersed under the above conditions except that the dispersion procedure was repeated four times to yield [Pigment-Wax Dispersion 2]. [Pigment-Wax Dispersion 2] had a solid content of 50%.

Example 3

A toner was produced and evaluated in the same manner as Example 1, except that the method for preparing the oil phase was changed as follows. The resultant [Toner 3] was shown in Table 1 as to the physical properties and in Table 2 as to the evaluations.

(Preparing of Oil Phase)

Into a reactor equipped with a stirring rod and a thermometer were poured 378 parts of [Lower Molecular-Mass Polyester 1], 400 parts of carnauba wax and 947 parts of ethylacetate. The mixture was heated at 80° C. for 4 hours with stirring and was then cooled to 30° C. over 1 hour. The mixture was further treated with 500 parts of [Master Batch 1] and 500 parts of ethylacetate with stirring for 2 hour, thereby yielded [Material Solution 3].

Thereafter, 1324 parts of [Material Solution 3] was poured into a vessel, and the components therein were dispersed using a bead mill (trade name: Ultra Viscomill, manufactured by by Aimex Co.) at a liquid feeding speed of 1 kg/hr, a disc rotation speed of 6 m/sec, using zirconia beads 0.5 mm in diameter filled 80% by volume. The dispersing procedure was repeated seven times. The dispersion was further treated with 1324 parts of 65% ethylacetate solution of [Lower Molecular-Mass Polyester 1], and the mixture was dispersed under the above conditions except that the dispersion procedure was repeated four times to yield [Pigment-Wax Dispersion 3]. [Pigment-Wax Dispersion 3] had a solid content of 50%.

Comparative Example 1

(Production Method of Polymer A)

Into a flask equipped with a stirrer, a condenser, a thermometer and an introducing tube of nitrogen, 300 g of methanol, 100 g of toluene, 570 g of styrene, 30 g of 2-acrylamide-2-methylpropane sulfonic acid and 12 g of lauroyl peroxide were charged and mixed, and the resultant mixture was subjected to a solution polymerization at 65° C. for 10 hours while introducing nitrogen into the flask, thereby yielded a reaction product. The yielded reaction product was taken out of the flask, dried at reduced pressure and ground using a jet-mill, thereby yielded the Polymer A having a mass-average molecular mass of 3,000.

(Production of Toner)

The composition of the toner comprising:

| | |
|---|---|
| styrene | 183 parts, |
| 2-ethylhexylacrylate | 17 parts, |
| Polymer A | 0.1 part, |
| C. I. Pigment Yellow 17 | 7 parts, |
| paraffin wax (trade name: manufactured by Taisei Kousan Co., Ltd., having a melting point of 155° F.) | 32 parts, and |
| polymerization initiator (trade name: V-601, manufactured by Wako Pure Chemicals Co., Ltd.) | 10 parts, |

was heated at 65° C. and dissolved or dispersed uniformly, thereby yielded a monomer composition. On the other hand, 0.3 g of a silane coupling agent (trade name: KBE 903, manufactured by Shin-Etsu Chemical Co., Ltd.) was dispersed uniformly in 1,200 ml of an ion-exchanged water and in the resultant dispersion, 6 g of a colloidal silica (trade name: Aerogil #200, manufactured by Nippon Aerogil Co., Ltd.) was uniformly dispersed. pH of the resultant dispersion was adjusted to 6 using an aqueous solution of hydrochloric acid, thereby yielded a dispersion. The resultant dispersion was mixed with the above-obtained monomer composition and the resultant mixture was stirred using the TK Homo Mixer at 70° C. in an atmosphere of nitrogen at 6,500 rpm for 60 minutes, thereby granulating the monomer composition. The granulated monomer composition was subjected to the polymerization at 75° C. while stirring the monomer composition using a paddle stirring propeller for 8 hours. After the polymerization reaction was completed, the reaction product was cooled and subjected to an alkali treatment over a night by mixing the reaction product with 42 g of a 20% aqueous solution of sodium hydroxide. Thereafter, the resultant reaction product was subjected to the treatments of dissolving a dispersant in the reaction product, filtering, a washing with water and drying, thereby yielded [Toner 4]. The resultant [Toner 4] was shown in Table 1 as to the physical properties and in Table 2 as to the evaluations.

Example 4

A toner was produced and evaluated in the same manner as Example 1, except that in the synthesis of the master batch, in the composition of the master batch, 100 parts of a polyester resin (having a glass transition point of 37° C.) having a tertiary amine group as an adsorbing group was incorporated as a pigment dispersant and the composition of the master batch was mixed using HENSCHEL MIXER and kneaded using a double roll mill. The resultant toner was shown in Table 1 as to the physical properties and in Table 2 as to the evaluations.

Example 5

A toner was produced and evaluated in the same manner as Example 1, except that in the preparing of the oil phase, 100 parts of a styrene-polyethylene polymer (having a glass transition point of 72° C. and a number average molecular mass of 7,100) was incorporated as a dispersing agent for the wax in the composition of the oil phase. The resultant toner was shown in Table 1 as to the physical properties and in Table 2 as to the evaluations.

Comparative Example 2

A toner was produced and evaluated in the same manner as Example 1, except that the method for preparing the oil phase was changed as follows. The resultant toner was shown in Table 1 as to the physical properties and in Table 2 as to the evaluations.

(Preparing of the Oil Phase)

Into a reactor equipped with a stirring rod and a thermometer were poured 378 parts of [Lower Molecular-Mass Polyester 1], 50 parts of carnauba wax, and 947 parts of ethylacetate. The mixture was heated at 80° C. for 1 hour with stirring and was then cooled to 30° C. over 1 hour. The mixture was further treated with 500 parts of [Master Batch 1] and 500 parts of ethylacetate with stirring for 10 minutes, thereby yielded [Material Solution 1].

Thereafter, 1324 parts of [Material Solution 1] was poured into a vessel, and the components therein were dispersed using a bead mill trade name: Ultra Viscomill, manufactured by Aimex Co.) at a liquid feeding speed of 1 kg/hr, a disc rotation speed of 6 m/sec, using zirconia beads 0.5 mm in diameter filled 80% by volume. The dispersing procedure was one time. The dispersion was further treated with 1324 parts of 65% ethylacetate solution of [Lower Molecular-Mass Polyester 1], and the mixture was dispersed under the above conditions except that the dispersion procedure was one time to yield [Pigment-Wax Dispersion 1]. [Pigment-Wax Dispersion 1] had a solid content of 50%.

The toner was evaluated as follows.

(Evaluation Items)

1) Dispersibility of Wax

Using a TEM (transmission electro microscope), the cross section of the toner was observed, so that the dispersion condition of the wax was evaluated. As the outermost surface of the toner particle, the portion of the toner particle which is in the range of from the surface to the depth of 0.3 μm in the toner particle was observed. "Dispersing uniformly" means that at least two wax particles are present in one toner particle and a large localized presence of the wax particles was not detected.

2) Image Fixing Properties (Hot-Offset Resistance and Low-Temperature Image Fixing Properties)

Using an imagio Neo 450 (manufactured by Ricoh Company, Ltd.) modified into a belt fixing system, solid images with adhering toner amount of 1.0±0.1 mg/cm$^2$ were printed on sheets of plain paper and thick paper (trade name: Type 6200, manufactured by Ricoh Company, Ltd. and NBS Ricoh Co., Ltd. copy and print paper <135>). An image fixing test was conducted with different fixing temperatures at a fixing belt, and the highest temperature at which no hot offset occurred on plain paper sheets was determined as highest fixing temperature. Also, lowest fixing temperature was measured using thick paper sheets. The lowest fixing temperature was determined as the temperature of a fixing roller at which a fixed image was rubbed with a pad and the remaining rate of the image density of the fixed image was 70% or more. It is generally desirable that the highest fixing temperature is 200° C. or more and the lowest fixing temperature is 140° C. or less.

3) Cleanability

After outputting 1,000 sheets of a 95% image-area ratio chart, transfer residual toner remaining on the photoconductor which had gone through a cleaning step was transferred to a sheet of white paper using a scotch tape (manufactured by Sumitomo 3M Limited) to measure the reflection density by a reflection densitometer (Macbeth reflection densitometer RD514). The density of the residual toner was measured and the cleaning properties of the toner were evaluated according to the following criteria.

A: the density of the remaining toner was less than 0.005 in comparison with the blanc.

B: the density of the remaining toner was 0.005 to 0.010 in comparison with the blanc.

C: the density of the remaining toner was 0.011 to 0.02 in comparison with the blanc.

D: the density of the remaining toner was more than 0.02 in comparison with the blanc.

4) Transfer Property

After a 20% image-area ratio chart was transferred from the, photoconductor to the paper, transfer residual toner remaining on the photoconductor right before a cleaning step was transferred to a sheet of white paper using a scotch tape (manufactured by Sumitomo 3M Limited) to measure the reflection density by a reflection densitometer 37 (Macbeth reflection densitometer RD514). The transfer properties of the toner were evaluated according to the following criteria.

A: the density of the remaining toner was less than 0.005 in comparison with the blanc.

B: the density of the remaining toner was 0.005 to 0.010 in comparison with the blanc.

C: the density of the remaining toner was 0.011 to 0.02 in comparison with the blanc.

D: the density of the remaining toner was more than 0.02 in comparison with the blanc.

5) Charge Stability

Using a test device of IPSiO Color 8100 (manufactured by Ricoh Company, Ltd.) modified into oilless fixing and applied tuning, the difference of charge amount for each toner was measured by conducting an endurance test of 100,000-sheet successive output with chart images of 5% toner coverage and thereby, the change of the charging amount was evaluated. The charge amount difference was obtained from 1 g of developer by way of a blow off method. The charge stability was evaluated according to the following criteria.

A: the difference was 5 μc/g or less

B: the difference was 10 μc/g or less

C: the difference was more than 10 μc/g

6) Image Density

Using a test device of imagio Neo 450 (manufactured by Ricoh Company, Ltd.) modified into belt fixing type, solid images with adhering toner amount of 0.4±0.1 mg/cm$^2$ were printed on sheets of plain paper (trade name Type 6200, manufactured by Ricoh Company, Ltd.). Then, the image density of the sheets was measured with X-Rite (manufactured by X-Rite Co.). The result was rated as follows.

A: the image density was 1.4 or more

B: the image density was less than 1.4

7) Image Graininess and Sharpness

Using a test device of IPSiO Color 8100 (manufactured by Ricoh Company, Ltd.) modified into oilless fixing and applied tuning, photographic images were output in monochrome and the levels of graininess and sharpness were evaluated visually. The result was rated as follows.

A: the image was as superior as offset prints

B: the image was slightly inferior to offset prints

C: the image was considerably inferior to offset prints

D: the image was substantially the same as conventional electrophotographic images thus was remarkably inferior image graininess and image sharpness 8) Fog Using a test device of IPSiO Color 8100 (manufactured by Ricoh Company, Ltd.) modified into oilless fixing and applied tuning under lower temperature of 10° C. and lower humidity of 15%, an endurance test of 100,000-sheet successive output with chart images of 5% toner coverage was conducted. Then, toner contamination of the background portion of printed sheets was evaluated visually using a magnifier. The result was rated as follows.

A: no contamination was observable

B: little contamination was observable and no troublesome

C: a little contamination was observable

D: considerable contamination was observable and troublesome

9) Toner Scatter

Using a test device of IPSiO Color 8100 (manufactured by Ricoh Company, Ltd.) modified into oilless fixing and applied tuning under a temperature of 40° C. and a humidity of 90%, an endurance test of 100,000-sheet successive output with chart images of 5% toner coverage was conducted for respective toners. Then, toner contamination within the test device was evaluated visually. The result was rated as follows.

A: no contamination was observable

B: little contamination was observable and no troublesome

C: a little contamination was observable

D: considerable contamination was observable and troublesome

10) Environmental Preservability (Blocking Resistance)

A sample of each toner was taken in an amount of 10 g and put in a 20 ml glass container. After being tapped for 100 times, the container was set in a thermostat at a temperature of 55° C. and humidity of 80% for 24 hours. Then, penetration was measured using a penetrometer. In addition, penetration of toner samples that were kept in a cold and dry environment (10° C., 15%) was also measured, and the lower value of penetration of the two conditions, i.e. hot and humid and cold and dry, was used for evaluation. The result was rated as follows.

A: penetration was 20 mm or more

B: penetration was 15 mm to 20 mm

C: penetration was 10 mm to 15 mm

D: penetration was less than 10 mm

11) Fixing Smear

Using a test device of IPSio Color 8100 (manufactured by Ricoh Company, Ltd.) modified into oilless fixing and applied tuning, the difference of charge amount for each toner was measured by conducting an endurance test of 10,000-sheet successive output with chart images of 5% toner coverage and thereby, the condition in which a slight amount of an offset substance attached to the fixing belt was reattached to the transferring paper was visually evaluated. The result was rated as follows.

A: no smear

B: a little smear per a sheet of paper

C: significant smear and no usable

The resultant toners in Examples 1 to 5 and Comparative Examples 1 to 2 are shown in Table 1 as to the physical properties and in Table 2 as to the evaluations.

As is apparent from the result shown in Tables 1 and 2, the toner according to the present invention in which the amount of the wax measured according to the DSC method and the FTIR-ATR method is in a specified range is excellent in the low-temperature image fixing properties and in hot-offset resistance by the reason that the lowest fixing temperature is lower and the highest fixing temperature is higher in comparison with the conventional toner, and is advantageous in environmental preservability, charging properties, developing properties and transfer properties. Also, by controlling the circularity, shape and particle diameter of the toner, a toner which does not have such a disadvantage as the fog of the image and the scattering of the toner, and has advantageous cleanability can be obtained.

The toner according to the present invention is excellent in the offset resistance, is advantageous in the blocking resistance without lowering charging properties and developing properties and can be preferably applied to the toner for developing the latent electrostatic image.

What is claimed is:

1. A toner comprising:

a binder resin, a colorant, and a wax,

TABLE 1

| | wax location in toner | wax dispersion in toner | Amout of wax (% by mass)*1 relative to amount of toner | Relative amount of wax*2 in surface to that in whole toner | Average circularlity | Form r2/r1 | Form r3/r2 | Particle diameter Volume average (Dv) | Particle diameter Number average (Dn) | Particle diameter Dv/Dn | Thermal properties Tg(° C.) |
|---|---|---|---|---|---|---|---|---|---|---|---|
| Ex. 1 | inside | uniform | 4.8 | 0.21 | 0.97 | 0.8 | 0.9 | 5.1 | 4.5 | 1.13 | 47 |
| Ex. 2 | inside | uniform | 4.7 | 0.09 | 0.94 | 0.6 | 0.8 | 6.5 | 4.8 | 1.35 | 46 |
| Ex. 3 | inside | uniform | 21 | 0.40 | 0.92 | 0.6 | 0.8 | 6.7 | 5.4 | 1.24 | 49 |
| Ex. 4 | inside | uniform | 4.7 | 0.17 | 0.97 | 0.7 | 0.8 | 5.3 | 4.5 | 1.18 | 34 |
| Ex. 5 | inside | uniform | 4.8 | 0.05 | 0.96 | 0.8 | 0.8 | 6.2 | 5.1 | 1.22 | 62 |
| Comp. Ex. 1 | inside | non-uniform | 23 | 0.18 | 0.96 | 0.7 | 0.8 | 7.1 | 5.8 | 1.22 | 69 |
| Comp. Ex. 2 | inside | non-uniform | 2.1 | 0.06 | 0.98 | 0.6 | 0.9 | 4.1 | 3.6 | 1.14 | 50 |

*1The amount of the wax relative to the amount of the toner was calculated by converting the endotherm of the wax measured according to the DSC method.

*2The relative amount of the wax in the surface of the toner to the amount of the wax in the whole toner was calculated by converting the strength ratio $P_{2850}/P_{828}$, wherein $P_{2850}$ and $P_{828}$ are strengths of the peaks, such as a peak at 2850 $cm^{-1}$ and a peak at 828 $cm^{-1}$ which are ascribed respectively to the wax and the binder resin which are present in a portion of the toner particle in a range which is from the surface to the depth of 3 μm in the toner particle, and $P_{2850}$ and $P_{828}$ were measured according to the FTIR-ATR method.

TABLE 2

| | Image-fixing properties Lowest fixing temperature (° C.) | Image-fixing properties Highest fixing temperature (° C.) | Cleanability | Transfer property | Charge stability | Image density | Image graininess and sharpness | Fog | Toner scatter | Environmental preservability | Fixing smear |
|---|---|---|---|---|---|---|---|---|---|---|---|
| Ex. 1 | 140 | 210 or more | B | B | B | A | B | B | B | B | A |
| Ex. 2 | 135 | 180 | B | B | A | A | B | A | B | A | A |
| Ex. 3 | 140 | 210 or more | A | B | B | A | C | B | C | B | A |
| Ex. 4 | 130 | 180 | B | A | B | A | A | A | A | C | B |
| Ex. 5 | 145 | 190 | B | B | A | A | B | B | B | B | B |
| Comp. Ex. 1 | 130 | 140 | D | D | B | A | B | C | D | D | C |
| Comp. Ex. 2 | 140 | 145 | D | D | D | B | B | D | D | D | C |

wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{825}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR is the value defining the amount of the wax which is present in the portion of the toner particle which is in the range of from the outermost surface to the depth of 0.3 □m in the toner particle; and at least a part of the wax is present as plural individual wax dispersion particles involved in the toner particle.

2. The toner according to claim 1, wherein the amount of the wax is 3% by mass to 20% by mass, based on the total mass of the toner.

3. The toner according to claim 1, wherein the wax dispersion particles are uniformly dispersed in the toner particle.

4. The toner according to claim 1, wherein a surface area of the wax which is present in the outermost surface of the toner particle is 5% or less, based on the area of the outermost surface of the toner particle.

5. The toner according to claim 1, wherein the toner has a path through which the wax is oozed out to the surface of the toner particle by heating and pressing the toner.

6. The toner according to claim 1, wherein the wax is any one of a carnauba wax from which a free fatty acid is eliminated, a rice wax, a montan wax, an ester wax and a combination thereof.

7. The toner according to claim 1, wherein the binder resin comprises a modified polyester resin.

8. The toner according to claim 7, wherein the binder resin comprises an unmodified polyester resin together with the modified polyester resin and the amount ratio of the modified polyester resin to the unmodified polyester resin in terms of the mass ratio is 5/95 to 80/20.

9. The toner according to claim 1, wherein the binder resin has a peak molecular mass of 1,000 to 10,000.

10. The toner according to claim 1, wherein the binder resin has a glass transition point (Tg) of 35° C. to 70° C.

11. The toner according to claim 7, wherein the toner is produced by subjecting a toner material-contained solution for producing the toner which is a dispersion in which at least a polyester prepolymer having a functional group containing a nitrogen atom, a polyester resin, a colorant and a releasing agent are dispersed in an organic solvent, to at least one of a crosslinking reaction and an elongation reaction in an aqueous medium.

12. The toner according to claim 11, wherein the toner is produced by dispersing the toner material-contained solution in an aqueous medium under the presence of resin fine particles.

13. The toner according to claim 1, wherein the toner has a volume average particle diameter (Dv) of 3.0 μm to 8.0 μm and a ratio (Dv/Dn) of the volume average particle diameter (Dv) to the number average particle diameter (Dn) of 1.00 to 1.40.

14. The toner according to claim 1, wherein the toner has an average circularity of 0.93 to 1.00.

15. The toner according to claim 1, wherein the toner has a substantially spherical shape.

16. The toner according to claim 1, wherein the shape of the toner is defined by a maximum length r1, a minimum length r2, and a thickness r3, wherein r1≧r2≧r3; and r2/r1 is 0.5 to 1.0, and r3/r2 is 0.7 to 1.0.

17. The toner according to claim 1, wherein at least one of a hydrophobic silica and a hydrophobic titanium oxide is added in the toner as an outer additive.

18. The toner according to claim 1, wherein the toner has a glass transition point (Tg) of 35° C. to 60° C.

19. A two-component developer for developing a latent electrostatic image comprising:

a toner, and a carrier, wherein the toner comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

20. An image forming apparatus comprising:

a photoconductor, a charging unit configured to charge the photoconductor, an exposing unit configured to expose the photoconductor for forming a latent electrostatic image, a developing unit configured to develop the latent electrostatic image using a toner for forming a toner image, which is supplied with the toner, a transferring unit configured to transfer the toner image carried on the photoconductor to a recording medium, and a fixing unit configured to fix the toner image carried on the recording medium, wherein the toner is a toner comprising a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

21. The image forming apparatus according to claim 20, wherein the fixing unit comprises a heater equipped with a heating element, a film contacted with the heater and a pressing member contacted with the heater through the film; and a recording medium carrying an unfixed image is inserted between the film and the pressing member so as to heat and fix the toner image.

22. The image forming apparatus according to claim 20, wherein the photoconductor is an amorphous silicon photoconductor.

23. The image forming apparatus according to claim 20, wherein the developing unit is equipped with an electric-field applying unit configured to apply an alternating electric field to the photoconductor for developing the latent image on the photoconductor.

24. The image forming apparatus according to claim 20, wherein the charging unit charges the photoconductor by contacting the photoconductor with a charging member of the charging unit and by applying a voltage to the charging member.

25. A process cartridge comprising:

a photoconductor, and at least one unit selected from the group consisting of:

a charging unit configured to charge the photoconductor, a developing unit configured to develop a latent electrostatic image using a toner for forming a toner image, which is supplied with the toner, and a cleaning unit configured to clean the toner remained on the photoconductor by using a blade after transferring the toner image, wherein the process cartridge is an integrated unit of the photoconductor and at least one unit selected from the group consisting of the charging unit, the developing unit and the cleaning unit and is attached to the main body of the image forming apparatus in an attachable and detachable manner; and the toner comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

26. An image forming process comprising:

charging a photoconductor, exposing the photoconductor for forming a latent electrostatic image, developing the latent electrostatic image using a toner for forming a toner image, transferring the toner image carried on the photoconductor to a recording medium, and fixing the toner image carried on the recording medium, wherein the toner comprises a binder resin, a colorant and a wax, wherein the amount of the wax in terms of the mass of the wax which is converted from an endotherm of the wax which is measured according to the DSC (differential scanning calorimeter) method is 3% by mass to 21% by mass, based on the total mass of the toner; the ratio ($P_{2850}/P_{828}$) of the strength of the peak (at 2850 $cm^{-1}$) ascribed to the wax to the strength of the peak (at 828 $cm^{-1}$) ascribed to the binder resin is in the range of from 0.01 to 0.40, wherein the ratio between the two peak strengths which is measured according to the FTIR-ATR (Fourier Transform Infrared Attenuated Total Reflectance Spectroscopy) is the value defining the amount of the wax which is present in the portion of the toner particle which is in the range of from the outermost surface to the depth of 0.3 μm in the toner particle; and at least a part of the wax is present as plural individual wax dispersion particles involved in the toner particle.

* * * * *